US008705760B2

(12) United States Patent
Mizuno

(10) Patent No.: US 8,705,760 B2
(45) Date of Patent: Apr. 22, 2014

(54) ACTIVE NOISE CONTROL DEVICE

(75) Inventor: Ko Mizuno, Osaka (JP)

(73) Assignee: Panasonic Corporation, Osaka (JP)

( * ) Notice: Subject to any disclaimer, the term of this patent is extended or adjusted under 35 U.S.C. 154(b) by 71 days.

(21) Appl. No.: 12/922,568

(22) PCT Filed: Mar. 17, 2010

(86) PCT No.: PCT/JP2010/001905
§ 371 (c)(1),
(2), (4) Date: Sep. 14, 2010

(87) PCT Pub. No.: WO2010/131405
PCT Pub. Date: Nov. 18, 2010

(65) Prior Publication Data

US 2012/0045070 A1 Feb. 23, 2012

(30) Foreign Application Priority Data

May 12, 2009 (JP) ..... 2009-115396

(51) Int. Cl.
*A61F 11/06* (2006.01)

(52) U.S. Cl.
USPC ..... 381/71.8; 381/71.2; 381/71.7; 381/89; 381/97; 379/406.05

(58) Field of Classification Search
USPC ..... 381/71.1, 71.2, 71.3, 71.4, 71.7, 71.8, 381/71.9, 71.11, 71.12, 71.13, 77, 80, 81, 381/89, 96, 97, 98, 100, 332, 333, 334, 335, 381/91, 95, 122, 124, 152, 337, 338, 339, 381/345, 346, 347, 348, 349, 350, 351, 353, 381/161, 162, 163, 59, 60, 61; 704/E21.014; 181/206; 700/94; 379/406.01, 406.02, 406.05, 406.06, 379/406.08, 406.09
See application file for complete search history.

(56) References Cited

U.S. PATENT DOCUMENTS

2004/0057584 A1 3/2004 Kakuhari et al.
2005/0111673 A1* 5/2005 Rosen et al. ..... 381/89

FOREIGN PATENT DOCUMENTS

| | | | |
|---|---|---|---|
| JP | 2-150198 | | 6/1990 |
| JP | 7-210174 | | 8/1995 |
| JP | 8-36392 | | 2/1996 |
| JP | 9-247784 | | 9/1997 |
| JP | 2000-324589 | | 11/2000 |
| JP | 2000324589 A | * | 11/2000 |
| JP | 2005-62786 | | 3/2005 |

* cited by examiner

*Primary Examiner* — Vivian Chin
*Assistant Examiner* — Leshui Zhang
(74) *Attorney, Agent, or Firm* — Wenderoth, Lind & Ponack, L.L.P.

(57) ABSTRACT

The active noise control device includes: a signal obtaining section that obtains an electric signal relating to the predetermined sound; a control section that adjusts an amplitude and a phase of the electric signal obtained by the signal obtaining section; a vibrating section having a diaphragm and a vibrator, the vibrator vibrating in accordance with an output from the control section. Because a sound radiated from the diaphragm toward the first region is substantially in opposite phase to that toward the second region, the control section controls the vibrator so that the diaphragm generates a sound that attenuates the predetermined sound in the first region, and causes the predetermined sound to have a desired frequency characteristic in the second region.

9 Claims, 30 Drawing Sheets

ACTIVE NOISE CONTROL DEVICE

TECHNICAL FIELD

The present invention relates to an active noise control device that controls an acoustic characteristic in a predetermined space so as to cause the acoustic characteristic to be a desired one.

BACKGROUND ART

Recently, television screens are becoming larger and their resolutions are becoming higher. At the same time, televisions are rapidly becoming thinner. Conventionally, televisions have been mounted on television cabinets or on television stands; however, recent televisions are thinner, and thus can be wall-mounted. It is expected that televisions will become even thinner and more users will mount their televisions on their walls.

Wall-mounting a television has an advantage of making effective use of a room space. Meanwhile, in an adjacent room across a wall on which the television is mounted, a speaker built in the television set, which is a sound source, is close to the wall when compared to a conventional installation method. This results in louder sound leakage from the built-in speaker to the adjacent room.

As an example of the sound transmission loss characteristic of a general residential wall, FIG. 28 shows the sound transmission loss characteristic of a double-layer plasterboard (12 cm thick) that is widely used for an internal wall of collective housing. In FIG. 28, at high frequency, a sound transmission loss is larger, which results in less sound leakage, while at low frequency, a sound transmission loss is less, which results in more sound leakage. Accordingly, a solution to decrease the sound leakage to the adjacent room, especially at low frequency, is necessary.

When a television is made thinner, a built-in speaker also needs to be made smaller and thinner. However, the smaller and thinner speaker cannot output a low-frequency sound at a sufficient level. For this reason, it is difficult for a recent wall-mounted television to provide a dynamic sound despite its large screen and high-definition images. This causes the viewer to feel uncomfortable. Accordingly, in the space where the viewer is located, a solution to increase the sound pressure level at low frequency is necessary.

As televisions are improved, especially made thinner, two opposite needs have risen. One is that, in the space where the viewer is located, the sound pressure level at low frequency needs to be increased, and the other is that, in the space of the room adjacent to the space where the viewer is located, the sound pressure level at low frequency needs to be decreased. For example, Patent Document 1 discloses a configuration of a conventional technique that realizes a desired acoustic output characteristic in a predetermined region and cancels a sound in a different predetermined region.

FIG. 29 is a block diagram illustrating a configuration of a loud speaker device disclosed in Patent Document 1. A conventional loud speaker device includes first signal processing means 1*a*, second signal processing means 1*b*, a delay device 2, a first sound source 3*a*, a second sound source 3*b*, a first detector 4*a*, a second detector 4*b*, and an adder 5. The first signal processing means 1*a* receives an acoustic signal. The second signal processing means 1*b* receives the signal processed by the first signal processing means 1*a*. The delay device 2 receives the acoustic signal and performs a given delay control on the acoustic signal and outputs a resultant signal. The first sound source 3*a* outputs a sound generated from the signal processed by the first signal processing means 1*a*. The second sound source 3*b* outputs a sound generated from the signal processed by the second signal processing means 1*b*. It is assumed that the first sound source 3*a* and the second sound source 3*b* are ideal speakers that output only sounds converted based on the signals processed by the first signal processing means 1 and by the second signal processing means 1*b*, respectively. The first detector 4*a* is arranged close to the first sound source 3*a* and detects the radiated sound from the first sound source 3*a*. The second detector 4*b* is arranged close to the second sound source 3*b* and detects the radiated sound from the second sound source 3*b*. The adder 5 adds the output from the delay device 2 to the output from the first detector 4*a*, and inputs the result to the first signal processing means 1*a*. Next, an operation of the loud speaker device in FIG. 29 will be described.

A delay amount is set to the delay device 2, the delay amount being about the same amount of time taken from the time when an acoustic signal is inputted to the first signal processing means 1*a* to the time when the sound is detected by the first detector 4*a*. The first signal processing means 1*a* controls the acoustic signal so that the output from the adder 5 becomes smaller, and outputs the resultant signal to the first sound source 3*a* and the second signal processing means 1*b*. The second signal processing means 1*b* controls the output from the first signal processing means 1*a* so that the output from the second detector 4*b* becomes smaller, and outputs the result to the second sound source 3*b*.

In accordance with the operation described above, the sum of the output from the first detector 4*a* and the output from the delay device 2 becomes closer to 0. In short, at the position of the first detector 4*a*, the pressure of a sound, whose acoustic signal is delayed for a predetermined time, can be obtained, the phase of the acoustic signal being inverted. Accordingly, if given a signal in opposite phase to a desired acoustic signal, the first sound source 3*a* can radiate a sound having a desired acoustic characteristic, at the position of the first detector 4*a*.

Meanwhile, the output from the second detector 4*b* becomes closer to 0. In short, at the position of the second detector 4*b*, the radiated sound from the first sound source 3*a* is cancelled by the sound radiated from the second sound source 3*b*.

Accordingly, the loud speaker device having the configuration shown in FIG. 29 can impart a desired acoustic characteristic to the radiated sound detected by the first detector 4*a*, and simultaneously reduce the radiated sound detected by the second detector 4*b*.

CITATION LIST

Patent Literature

[PTL 1] Japanese Laid-Open Patent Publication No. 2000-324589

SUMMARY OF THE INVENTION

Problems to be Solved by the Invention

However, it is difficult to apply the conventional technology to the above-described need, that is to say, to increase the sound pressure level at low frequency in the space where the viewer is located and to decrease the sound pressure level at low frequency in the space of the room adjacent to the space where the viewer is located. Generally, a low-frequency sound has low directivity and tends to expand in all directions. When two sound sources that radiate low-frequency sounds are positioned close to each other, the degree of coincidence of the sound pressure distributions formed by the respective radiated sounds increases, and thus it is difficult to decrease the sound pressure level at a predetermined position and simultaneously increase the sound pressure level at a different position.

FIG. 30 is a diagram to explain the reason for this in detail. FIG. 30 illustrates an example where the first sound source 3*a* and the second sound source 3*b* each radiates a low-frequency sound and each of the radiated sounds expands in all directions to be propagated to both of the first detector 4*a* and the second detector 4*b*. Reference numerals in FIG. 30 denote the following.

$S_1$: an acoustic wave propagated from the first sound source 3*a* to the first detector 4*a*

$S_2$: an acoustic wave propagated from the second sound source 3*b* to the second detector 4*b*

$DS_1$: an acoustic wave propagated from the first sound source 3*a* to the second detector 4*b*

$DS_2$: an acoustic wave propagated from the second sound source 3*b* to the first detector 4*a*

D: the distance between the first sound source 3*a* and the second sound source 3*b*

$d_1$: the distance between the first sound source 3*a* and the first detector 4*a* (the propagation path length of the acoustic wave $S_1$)

$d_2$: the distance between the second sound source 3*b* and the second detector 4*b* (the propagation path length of the acoustic wave $S_2$)

It is assumed that the first detector 4*a* is arranged close to the first sound source 3*a* and the second detector 4*b* is arranged close to the second sound source 3*b*, and $d_1$ and $d_2$ are equal to the same distance d.

The intensity of the acoustic wave $S_1$ detected by the first detector 4*a* is denoted by $I_1$, the intensity of the acoustic wave $S_2$ detected by the second detector 4*b* is denoted by $I_2$, the intensity of the acoustic wave $DS_1$ detected by the second detector 4*b* is denoted by $DI_1$, the intensity of the acoustic wave $DS_2$ detected by the first detector 4*a* is denoted by $DI_2$, and the intensity of a desired acoustic wave at the position of the first detector 4*a* is denoted by I. In addition, the propagation path length of the acoustic wave $DS_1$ is denoted by $L_1$, and the propagation path length of the acoustic wave $DS_2$ is denoted by $L_2$. It is assumed that in a space shown in FIG. 30, when the acoustic wave propagation characteristic is uniform, the path length of the acoustic wave $DS_1$ and that of the acoustic wave $DS_2$ are the same. In this situation, $L_1$ and $L_2$ are denoted by L.

The acoustic wave is attenuated in inverse proportion to the square of the distance. Hence, [Formula 1] and [Formula 2] are satisfied. It is noted that δ in [Formula 1] and [Formula 2] is the square of d/L, and δ is termed an attenuation rate.

$$DI_1 = \left(\frac{d_1}{L_1}\right)^2 \cdot I_1 = \left(\frac{d}{L}\right)^2 \cdot I_1 = \delta \cdot I_1 \quad \text{[Formula 1]}$$

$$DI_2 = \left(\frac{d_2}{L_2}\right)^2 \cdot I_2 = \left(\frac{d}{L}\right)^2 \cdot I_2 = \delta \cdot I_2 \quad \text{[Formula 2]}$$

Here, in order for the acoustic wave $S_2$ to cancel the acoustic wave $DS_1$ at the position of the second detector 4*b*, the acoustic wave $S_2$ needs to be in opposite phase to the acoustic wave $DS_1$ at the position of the second detector 4*b*, and $DI_1$ and $I_2$ must be equal. Hence, the following [Formula 3] is satisfied.

$$I_2 = DI_1 = \delta \cdot I_1 \quad \text{[Formula 3]}$$

As described above, suppose that the second sound source 3*b* radiates the acoustic wave $S_2$ that cancels the acoustic wave $DS_1$ at the position of the second detector 4*b*. In this situation, because the difference in path length between the acoustic wave $DS_1$ and the acoustic wave $S_2$ is equal to that between the acoustic wave $DS_2$ and the acoustic wave $S_1$, the acoustic wave $S_1$ is in opposite phase to the acoustic wave $DS_2$ also at the position of the second detector 4*a*. Accordingly, the intensity $I_r$ of the acoustic wave detected by the first detector 4*a* can be represented by the following [Formula 4] using [Formula 2] and [Formula 3].

$$I_r = I_1 - DI_2 = I_1 - \delta^2 \cdot I_1 = (1-\delta^2) \cdot I_1 \quad \text{[Formula 4]}$$

In order for this Ir to be a desired intensity I, $I_1$ needs to be a value represented by the following [Formula 5].

$$I_1 = \frac{I}{1-\delta^2} \quad \text{[Formula 5]}$$

Here, when the distance D between the first sound source 3*a* and the second sound source 3*b* is short, δ is close to 1. Accordingly, the first sound source 3*a* needs to radiate a very large sound. However, there is a limit in the intensity of the sound that can be radiated from the first sound source 3*a*. Thus, the distance D needs to be secured so as not to exceed the limit. Accordingly, when the distance D is short, it is not possible to decrease the sound pressure level at a predetermined position and simultaneously increase the sound pressure level at a different position.

For this reason, as a speaker built in a television set, two speakers that correspond to the first sound source 3*a* and second sound source 3*b* need to be arranged apart from each other. As a consequence, the thickness of the television is increased, which contradicts the advantage of a wall-mounted television that makes effective use of a room space.

Therefore, an object of the present invention is to arrange two sound sources close to each other, the two sound sources controlling sounds, and to decrease the sound pressure level at a predetermined position and to simultaneously increase the sound pressure level at a different position. In particular, an object of the present invention is to decrease the sound pressure level at low frequency at a predetermined position and to simultaneously increase the sound pressure level at low frequency at a different position.

Solution to the Problems

To achieve the above object, the present invention has the following features. The active noise control device according to the present invention attenuates, in a first region (302) behind a speaker, a first sound radiated from the speaker, and includes: a vibrating section that radiates, by vibrating in accordance with a control signal, a second sound toward the first region, and a third sound in opposite phase to the second sound toward a second region in front of the speaker; a signal obtaining section that obtains, from the speaker, an electric signal relating to the first sound and inputted to the speaker; and a control section that adjusts, based on previously stored control parameters, an amplitude and a phase of the electric signal obtained by the signal obtaining section and outputs, to the vibrating section, the adjusted electric signal as the control signal so that the first sound is attenuated by the second sound in the first region and that a synthesized sound of the first sound and the third sound has a desired frequency characteristic in the second region.

In addition, the active noise control device according to the present invention may include a signal detection microphone that detects the synthesized sound of the first sound and the third sound and outputs the detected synthesized sound as an electric signal. The signal obtaining section may obtain, instead of the electric signal relating to the first sound, an electric signal outputted from the signal detection microphone.

The active noise control device according to the present invention, may further include: an echo cancelling section that generates, based on the control signal, a pseudo echo signal of a signal that is predicted to be outputted afterward from the signal detection microphone when the signal detection microphone has picked up the sound generated in accordance with the control signal by the vibrating section; and a subtractor that subtracts the pseudo echo signal from the electric signal obtained by the signal obtaining section. The control section may generate the control signal that is obtained by adjusting an amplitude and a phase of, instead of the signal obtained by the signal obtaining section, an electric signal outputted from the subtractor.

The active noise control device according to the present invention may further include: a first detection microphone that detects a sound in the first region, and outputs the detected sound as an electric signal; and a second detection microphone that detects the synthesized sound of the first sound and the third sound, and outputs the detected synthesized sound as an electric signal. The control section may include a control parameter setting section that sets the control parameters based on: the electric signal relating to the first sound; the electric signal outputted from the first detection microphone; and the electric signal outputted from the second detection microphone.

The active noise control device according to the present invention may further includes: a vibration detecting section that detects vibration excited by a sound pressure in the first region, and outputs the detected vibration as an electric signal; and a second detection microphone that detects the synthesized sound of the first sound and the third sound, and outputs the detected synthesized sound as an electric signal. The control section may include a control parameter setting section that sets the control parameters based on: the electric signal relating to the first sound; the electric signal outputted from the vibration detecting section; and the electric signal outputted from the second detection microphone.

The signal obtaining section may further obtain a characteristic setting signal for setting an acoustic output characteristic of the speaker. The control section may include a processing characteristic update section that detects the acoustic output characteristic from the characteristic setting signal, and that updates the control parameters, in accordance with the detected acoustic output characteristic.

The active noise control device according to the present invention may further include a third detection microphone that detects the sound in the first region and outputs the detected sound as an electric signal. The control section may include a processing characteristic update section that updates the control parameters so as to attenuate the sound detected by the third detection microphone.

The active noise control device according to the present invention may further include a vibration detecting section that detects vibration excited by a sound pressure in the first region, and outputs the detected vibration as an electric signal. The control section may include a processing characteristic update section that updates the control parameters so as to attenuate the vibration detected by the vibration detecting section.

The active noise control device according to the present invention may further include a fourth detection microphone that detects the synthesized sound of the first sound and the third sound, and outputs the detected synthesized sound as an electric signal. The control section may include a processing characteristic update section that updates the control parameters so that the synthesized sound detected by the fourth detection microphone has a desired frequency characteristic.

Further, the control section may adjust the amplitude and the phase of the electric signal obtained by the signal obtaining section so that the amplitude and the phase of the first sound do not change, at a frequency where the difference between: the phase difference between the first sound in the first region and the first sound in the second region; and the phase difference between the second sound and the third sound, is substantially N×360 degrees (N is an integer).

The active noise control device according to the present invention may further include a baffle section that prevents the second sound from being propagated to the second region, and that prevents the third sound from being propagated to the first region.

Further, the active noise control device according to the present invention may include an enclosed space that is provided between the first region and the second region, and is formed at least by the vibrating section, and a boundary wall between the first region and the second region. The second sound is propagated to the enclosed space from the vibrating section.

A method of installing the active noise control device according to the present invention, the active noise control device attenuating, in a second room adjacent to a first room across a boundary wall, a sound radiated from the speaker arranged in the first room, and the method may include the steps of: providing an enclosed space that is formed at least by the vibrating section and the boundary wall; and installing the active noise control device between the second room and the speaker.

An acoustic system according to the present invention includes: the speaker arranged in a first room; the active noise control device according to the present invention that is installed between a second room adjacent to the first room across a boundary wall and the speaker; and an enclosed space formed at least by a surface of the boundary wall in the first room, and the active noise control device.

Advantageous Effects of the Invention

An active noise control device according to the present invention vibrates, based on a control signal from a control section, a vibrating section in accordance with a sound from a speaker, thereby attenuating a predetermined sound in a first region and providing a desired sound quality to the predetermined sound in a second region different from the first region. In addition, because the vibrating section can radiate two acoustic waves in opposite phase to each other, respectively toward the first region and the second region, the speaker and the vibrating section can be arranged close to each other.

DESCRIPTION OF EMBODIMENTS (First Embodiment)

Figure 1:
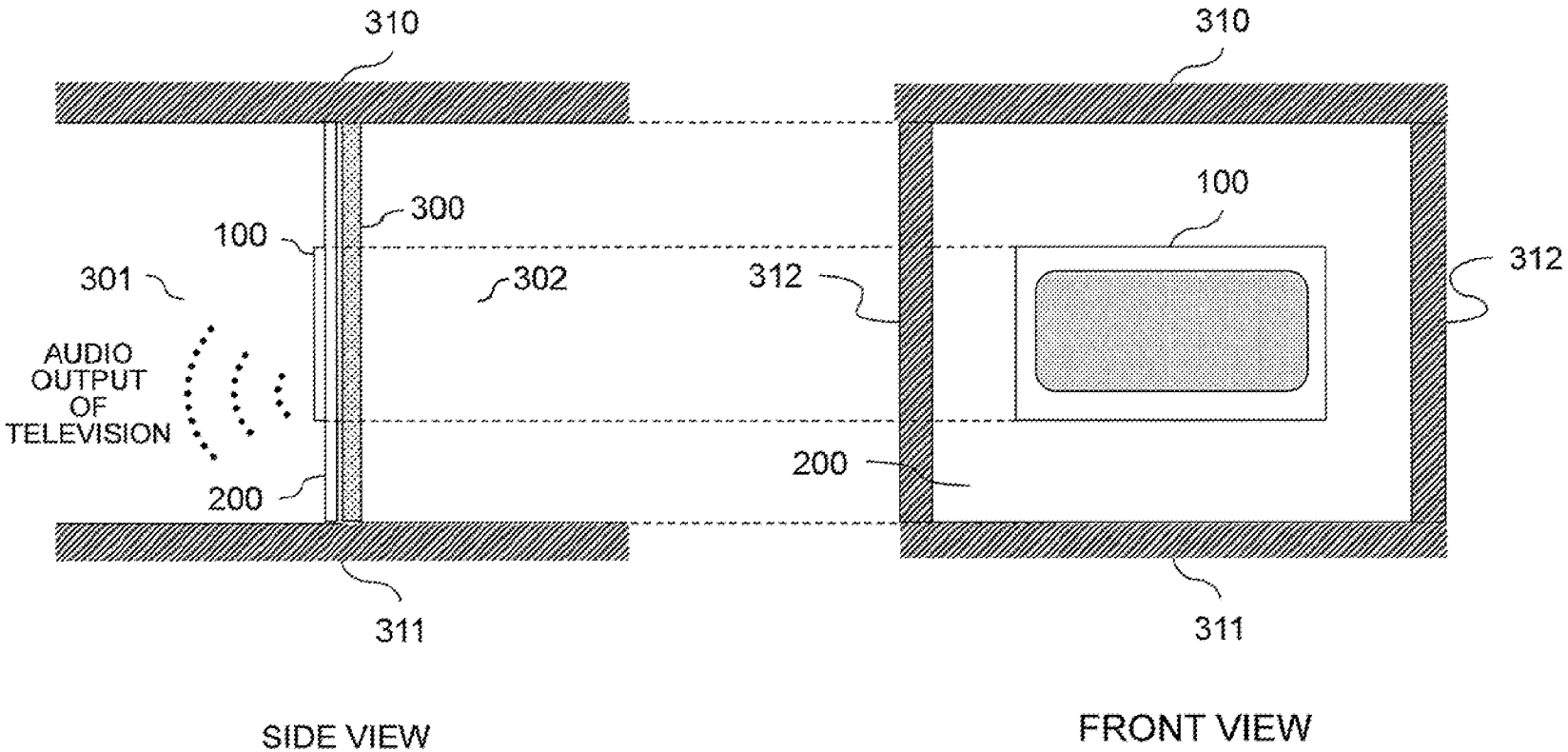
FIG. 1 illustrates an arrangement example of an active noise control device 200 according to a first embodiment of the present invention.

FIG. 1 illustrates an arrangement of an active noise control device according to a first embodiment of the present invention. The left part of FIG. 1 is a side view of a television, and the right part of FIG. 1 is a front view of the television.

In FIG. 1, an active noise control device 200 is arranged close to a boundary wall 300, and a television 100 is fixed to the active noise control device 200. The active noise control device 200 has a function, in a viewing room 301, of improving television audio so as to provide the television audio with a desired characteristic having an increased sound pressure level at low frequency. Further, the active noise control device 200 has a function, in an adjacent room 302, of decreasing the sound pressure level of the television audio, especially at low frequency.

Figure 2:
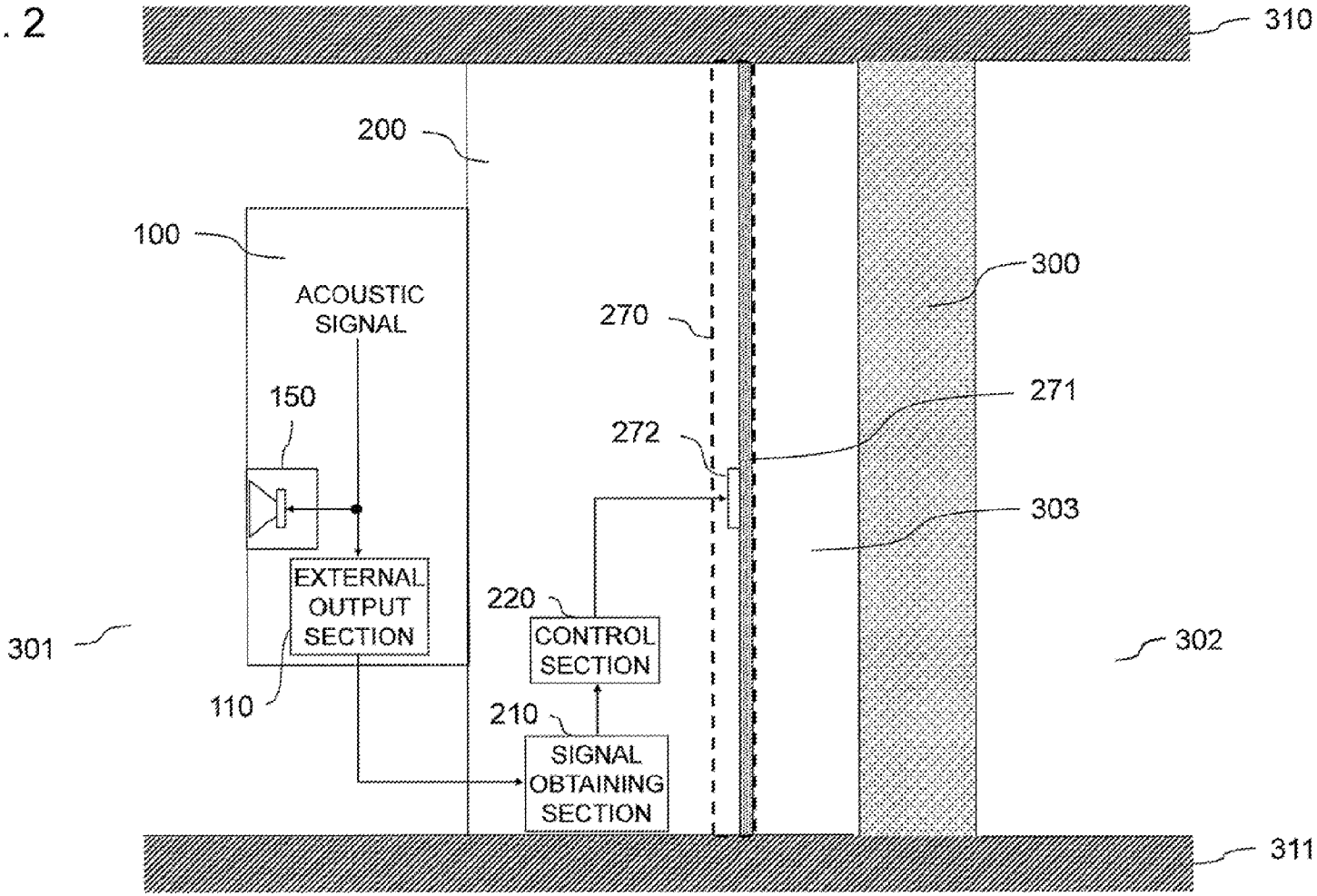
FIG. 2 illustrates an example of an internal configuration of a television 100 and the active noise control device 200 according to the first embodiment of the present invention.

FIG. 2 illustrates an internal configuration of the television 100 and the active noise control device 200. In FIG. 2, the active noise control device 200 is arranged such that a gap 303 is interposed between the boundary wall 300 and the active noise control device 200. The television 100 includes an external output section 110 and a speaker 150. The active noise control device 200 includes a signal obtaining section 210, a control section 220, and a vibrating section 270. The vibrating section 270 includes a diaphragm 271 and a vibrator 272.

The speaker 150 outputs the audio of the television 100. The speaker 150 shown in FIG. 2 is built in the television 100;

however, the speaker 150 may be externally attached to the television 100, or may be separated from the television 100. The external output section 110 corresponds to an audio output terminal that an existing television usually has, and outputs an acoustic signal relating to the audio of the television 100 as an electric signal.

Figure 3:
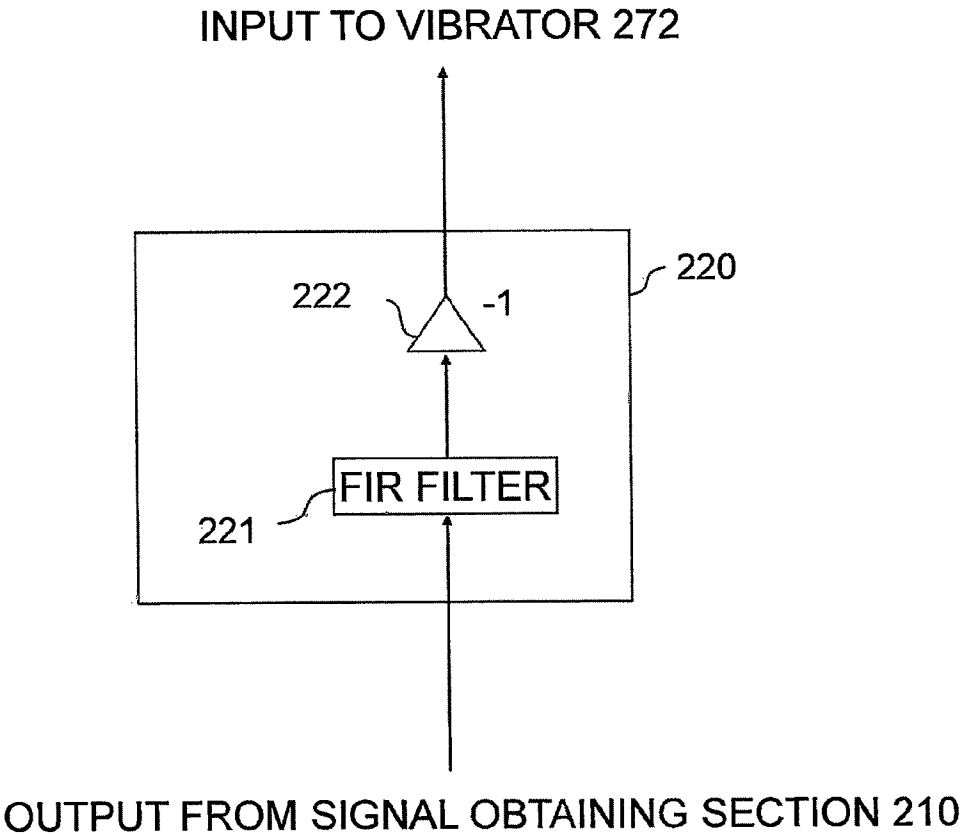
FIG. 3 illustrates an internal configuration of a control section 220 according to the first embodiment of the present invention.

The signal obtaining section 210 obtains the signal outputted from the external output section 110 of the television 100. The control section 220 corrects the signal obtained by the signal obtaining section 210 so that the corrected signal has a predetermined amplitude-phase characteristic. FIG. 3 illustrates an internal configuration of the control section 220. In FIG. 3, the control section 220 includes an FIR filter 221 and a phase inverter 222. The FIR filter 221 corrects an input signal so that the corrected signal has a predetermined amplitude-phase characteristic, and outputs the corrected signal. The phase inverter 222 inverts the phase of the corrected signal inputted thereto.

In FIG. 2, the vibrator 272 is attached to the surface of the diaphragm 271 and applies, in accordance with a control signal from the control section 220, vibration to the diaphragm 271 in the outward direction from the surface of the diaphragm 271. Accordingly, the diaphragm 271 radiates a sound bidirectionally in the forward and the backward directions thereof. The active noise control device 200, in the region of the viewing room 301, improves an audio output from the television 100 so that the audio output has a desired characteristic, and in the region of the gap 303, cancels the audio output from the television 100.

The gap 303 is, as shown in the front view in FIG. 1, and FIG. 2, a space enclosed by the diaphragm 271, the boundary wall 300, a ceiling 310, a floor surface 311, and side walls 312. Being enclosed, the gap 303 becomes a uniform acoustic field, which enables the active noise control device 200 to control the acoustic field of the region 303 by controlling only one point of the diaphragm 271. Accordingly, the active noise control device 200 can easily cancel an audio output from the television 100 in the whole region of the gap 303.

Figure 4:
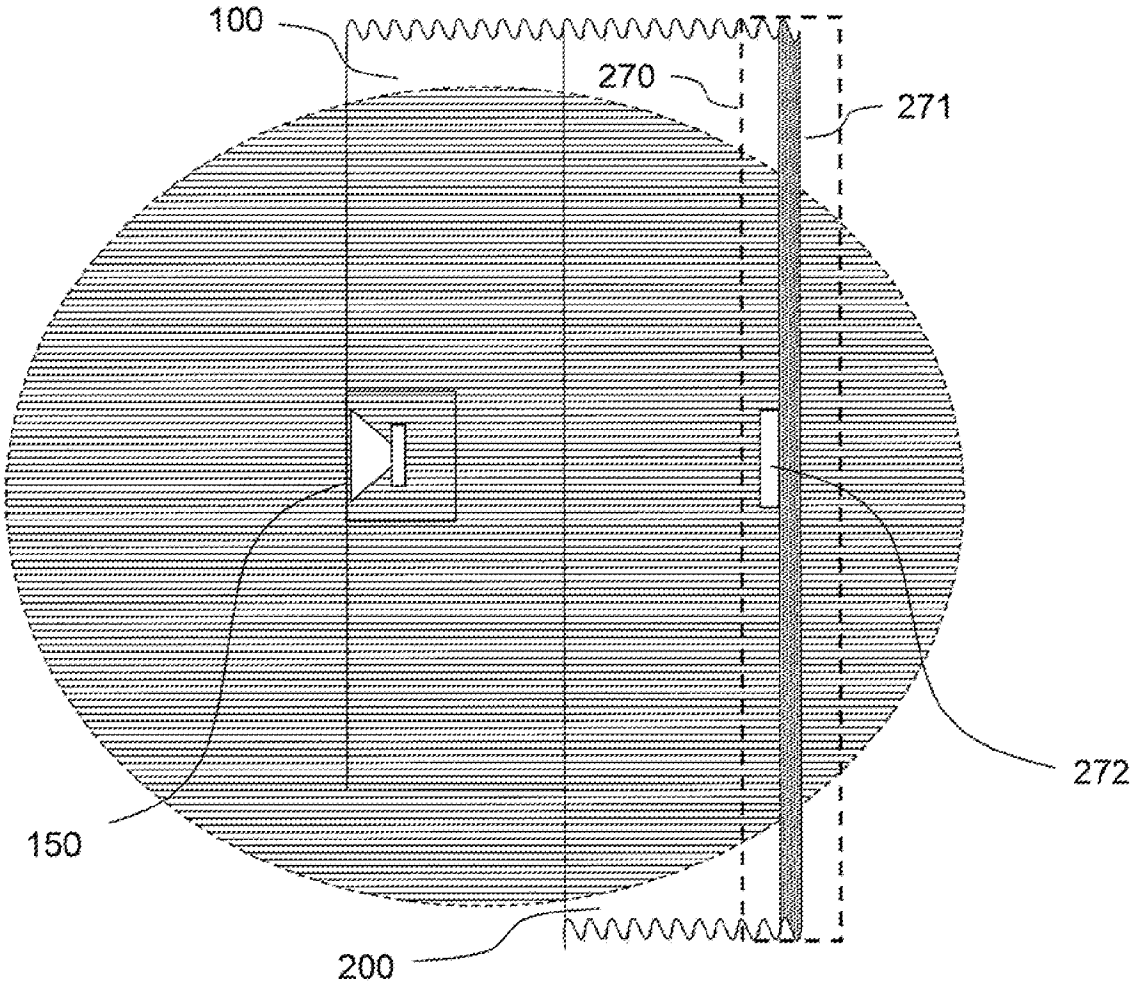
FIG. 4 illustrates a directional characteristic and a phase status of a radiated sound from a speaker 150 according to the first embodiment of the present invention.
Figure 5:
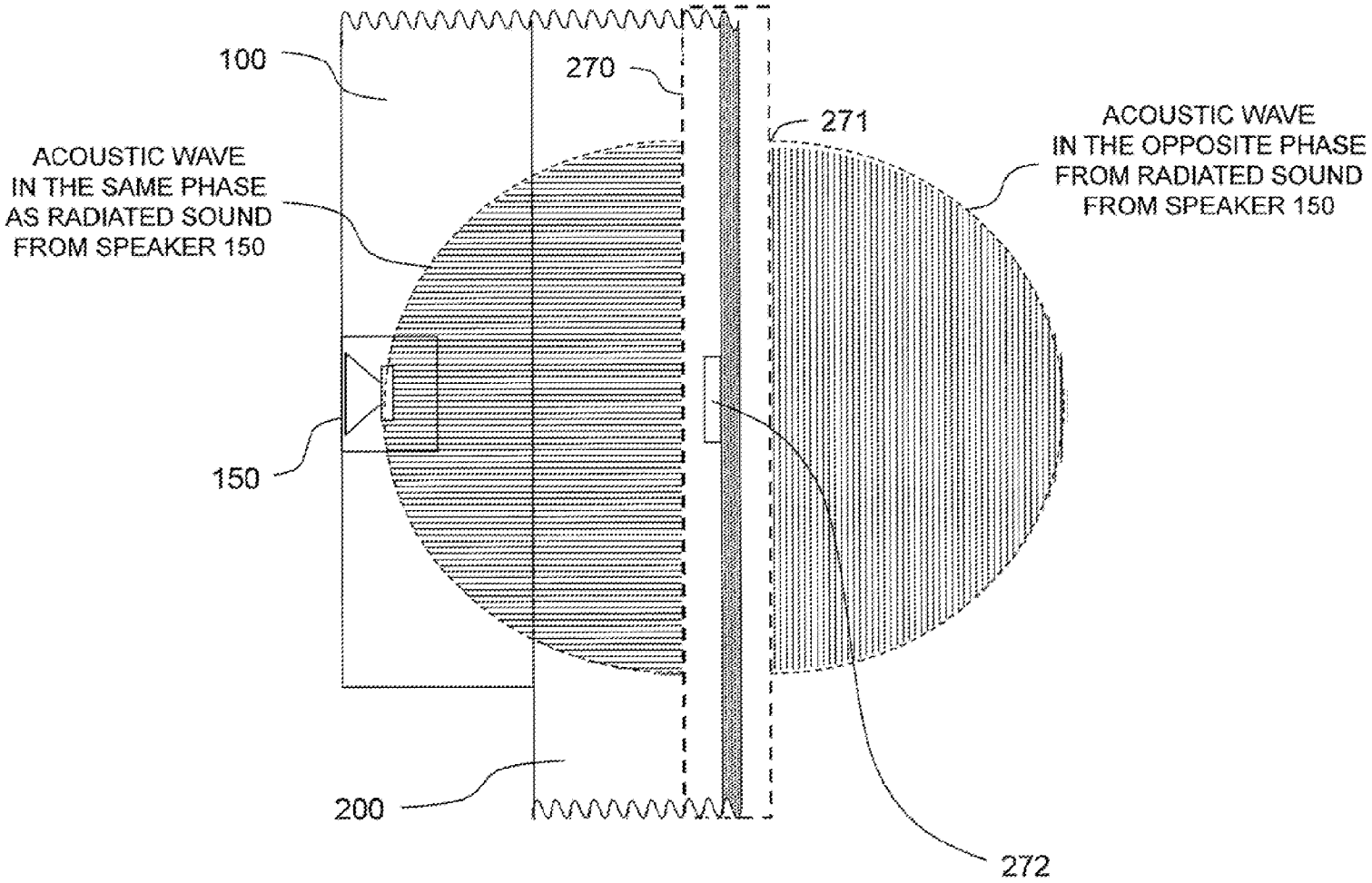
FIG. 5 illustrates a directional characteristic and a phase status of a radiated sound from a vibrating section 270 according to the first embodiment of the present invention.

Next, with reference to FIG. 4 and FIG. 5, the phase status of a sound radiated from the speaker 150 and the phase status of a sound radiated from the active noise control device 200 will be described. The speaker 150 is usually fixed facing the same direction (the forward direction) as the screen of the television 100, and radiates a sound in the forward direction. However, the lower the frequency is, the more the sound is propagated in the backward direction due to the sound diffraction phenomenon. As a result, a low-frequency sound radiated from the speaker 150 is, as shown in FIG. 4, propagated uniformly in phase from the speaker 150 as a center. The active noise control device 200 also radiates a sound bidirectionally toward the region 301 and toward the region 303 in accordance with vibration of the diaphragm 27. However, because the vibration of the diaphragm 271 in one of the two regions is in opposite phase to the vibration of the diaphragm 271 in the other region, the radiated sounds in respective regions are also in opposite phase to each other. As a result, the low-frequency sound radiated from the active noise control device 200 is, as shown in FIG. 5, propagated bidirectionally toward the region 301 and toward the region 303, from the diaphragm 271 as a center, as sounds in opposite phase to each other.

Next, an operation of the active noise control device 200 will be described. The signal obtaining section 210 obtains, from the external output section 110 of the television 100, an acoustic signal outputted to the speaker 150. The acoustic signal obtained by the signal obtaining section 210 is based on output settings of the television 100 determined by a viewer not shown in the drawings. This acoustic signal is not limited to an acoustic signal separated from a broadcast wave, and may include, for example, an acoustic signal inputted to the television 100 from an external device such as a Blu-ray player/recorder. Further, this acoustic signal may be an analog signal, or may be a digital signal.

The signal obtaining section 210 outputs the obtained acoustic signal to the control section 220. The control section 220 generates a control signal obtained by correcting an input signal so that the corrected signal has a predetermined amplitude-phase characteristic, and outputs the generated control signal. Consequently, a synthesized sound of the sound radiated from the speaker 150 and the sound radiated from the active noise control device 200 can have the above-described desired characteristic in the region 301, and the sound radiated from the speaker 150 and the sound radiated from the active noise control device 200 can cancel each other in the region 302. The control signal outputted from the control section 220 is amplified, as necessary, to a predetermined level by an amplifier not shown in the diagrams, and is inputted to the vibrator 272.

Figure 6:
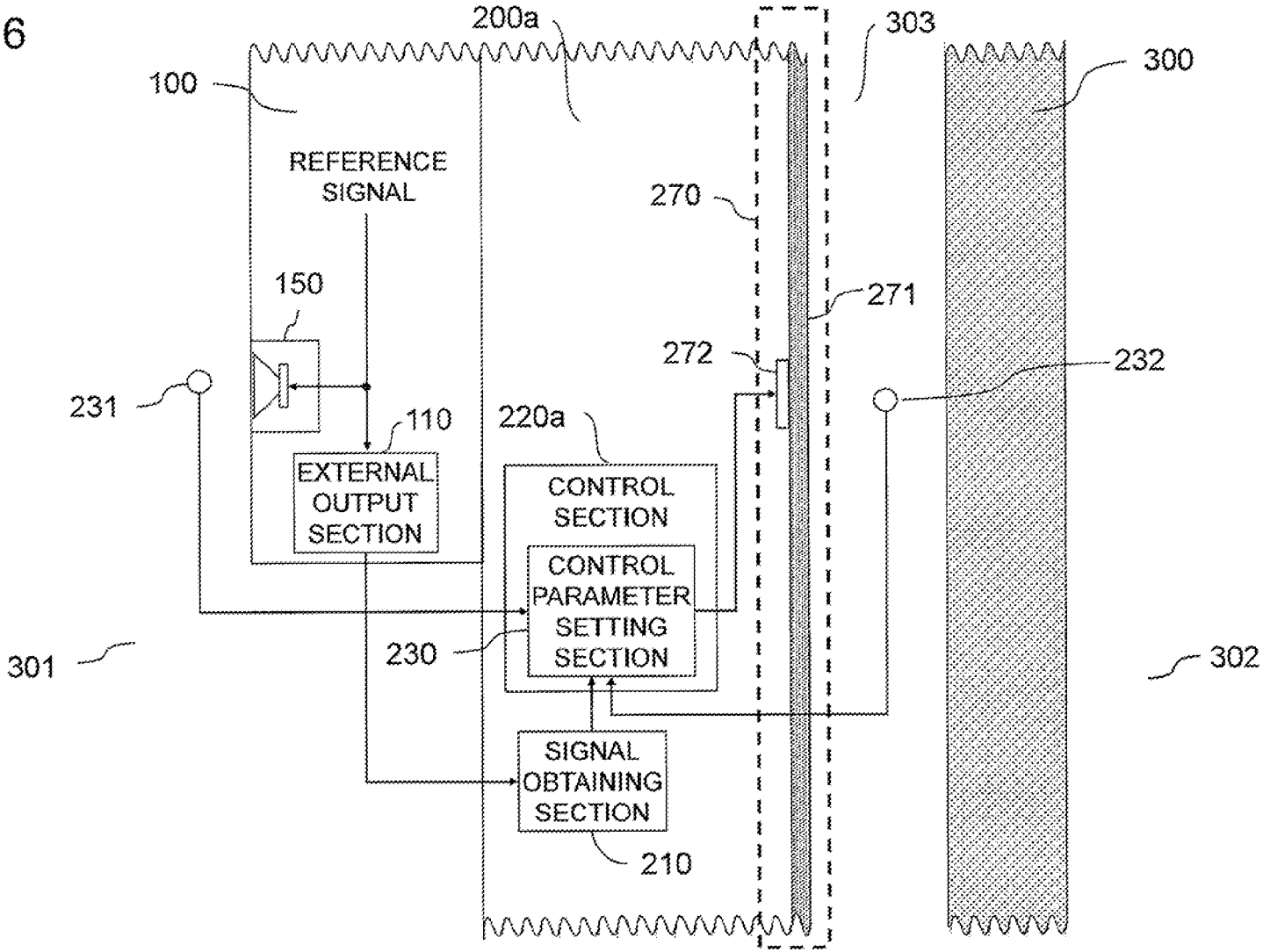
FIG. 6 illustrates an example of an internal configuration of the television 100 and an active noise control device 200*a* including a control parameter setting section 230 according to the first embodiment of the present invention.

Next, a method of setting the control parameters of the control section 220 will be described. FIG. 6 illustrates an example of an internal configuration of the television 100 and an active noise control device 200*a* where a control section 220*a* includes components required for setting the control parameters. The active noise control device 200*a* includes a signal obtaining section 210, the control section 220*a*, a vibrating section 270, a first detection microphone 231, and a second detection microphone 232. The control section 220*a* includes a control parameter setting section 230.

The first detection microphone 231 is arranged in the region 301, and detects a synthesized sound of a sound radiated from the speaker 150 and a sound radiated from the active noise control device 200*a* and outputs the detected synthesized sound as an electric signal. The second detection microphone 232 is arranged in the region 303, and detects the synthesized sound of the sound radiated from the speaker 150 and the sound radiated from the active noise control device 200*a* and outputs the detected synthesized sound as an electric signal. The speaker 150 receives, not an acoustic signal such as a broadcast wave, a broadband reference signal such as white noise. The external output section 110 and the signal obtaining section 210 operate in the same manner as those shown in FIG. 2, and thus descriptions thereof are omitted.

Figure 7:
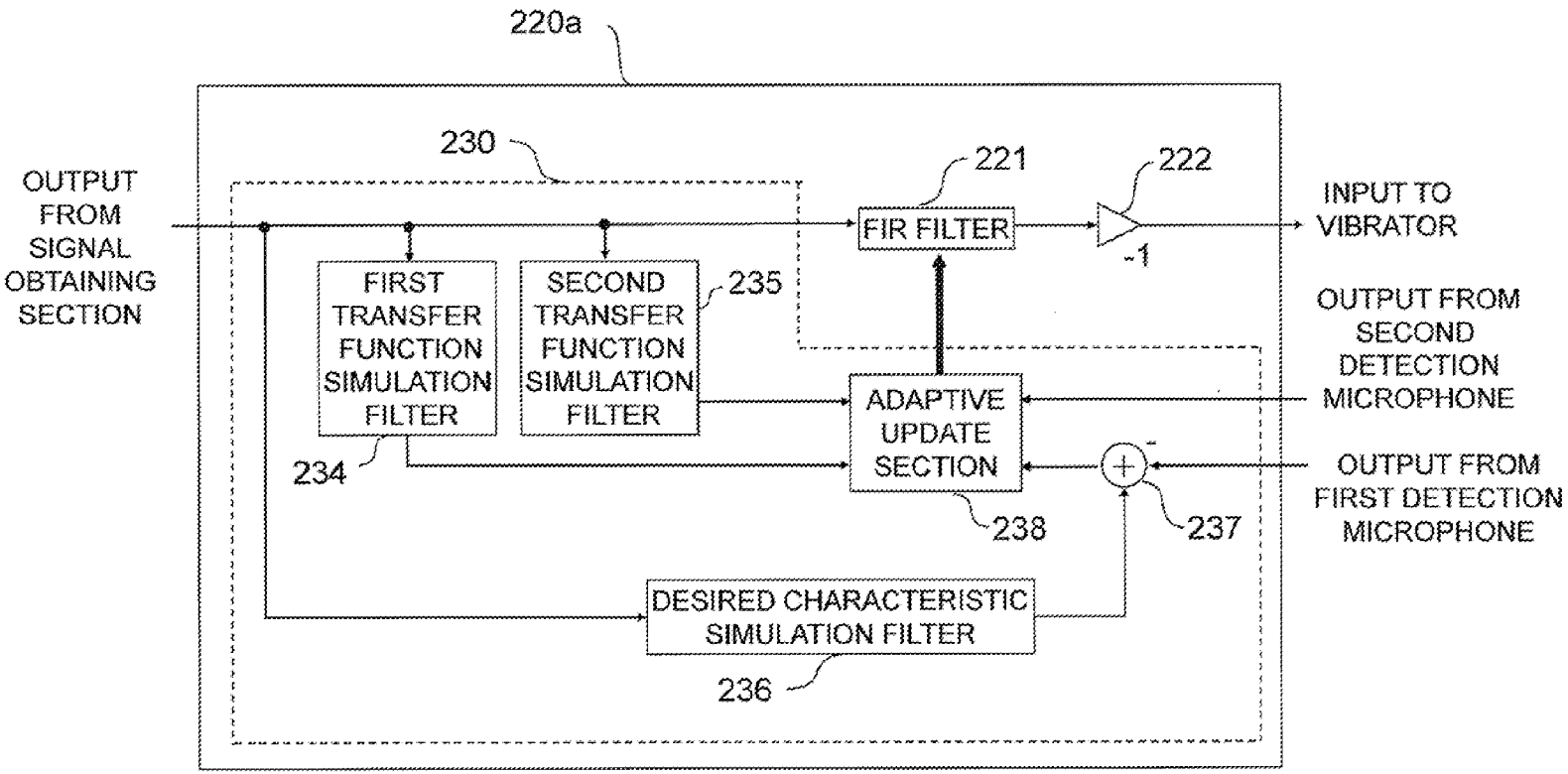
FIG. 7 illustrates an internal configuration of a control section 220*a* including the control parameter setting section 230 according to the first embodiment of the present invention.

The control parameter setting section 230 receives, in addition to an output from the signal obtaining section 210, an output from the first detection microphone 231 and an output from the second detection microphone 232. Then, based on these received outputs, the control parameter setting section 230 operates so as to update the control parameters of the control section 220*a*, specifically, a filter coefficient of the FIR filter 221. FIG. 7 illustrates an internal configuration of the control section 220*a*. In FIG. 7, the control parameter setting section 230 includes a first transfer function simulation filter 234, a second transfer function simulation filter 235, a desired characteristic simulation filter 236, a subtractor 237, and an adaptive update section 238. The FIR filter 221 and the phase inverter 222 operate in the same manner as the components shown in FIG. 3, and thus descriptions thereof are omitted.

The first transfer function simulation filter 234 generates a filtered reference signal $x_1(n)$ (n is a sampling time) by convolving, to a signal outputted from the signal obtaining section 210, the characteristic of an error path from an input to the vibrator 272 to an output from the first detection microphone 231. To the first transfer function simulation filter 234 which is an FIR filter, a coefficient is given, the coefficient being a value obtained by discretizing a transfer function impulse response between the input to the vibrator 272 and the output from the first detection microphone 231. The second transfer function simulation filter 235 generates a filtered reference signal $x_2(n)$ (n is a sampling time) by convolving, to the signal outputted from the signal obtaining section 210, the characteristic of an error path from an input to the vibrator 272 to an output from the second detection microphone 232. Also to the second transfer function simulation filter 235, a coefficient is given, the coefficient being a value obtained by discretizing a transfer function impulse response between the input to the vibrator 272 and the output from the second detection microphone 232. The desired characteristic simulation filter 236 generates a reference signal by convolving, to the signal outputted from the signal obtaining section 210, an acoustic characteristic desired in the region 301. To the desired characteristic simulation filter 236 which is also an FIR filter, a coefficient is given, the coefficient being a value obtained by discretizing an impulse response of the acoustic characteristic desired in the region 301. The difference between an output from the desired characteristic simulation filter 236 and an output from the first detection microphone 231, the difference outputted from the subtractor 237, is equivalent to the error between the above-described desired characteristic and the sound pressure characteristic in the region 301.

The adaptive update section 238 obtains a filter coefficient of an FIR filter that can minimize E(n) in [Formula 6] so as to reduce both an output $e_1(n)$ of the subtractor 237 and an output $e_2(n)$ of the second detection microphone 232 at the sampling time n.

$$E(n)=\{e_1(n)\}^2+\{e_2(n)\}^2 \quad \text{[Formula 6]}$$

The adaptive update section 238, based on a Filtered-X LMS algorithm represented by the following formula, calculates the filter coefficient of an FIR filter and sequentially sets the calculated filter coefficient in the FIR filter 221.

$$G(n+1)=G(n)+2\mu_1 e_1(n)x_1(n)+2\mu_2 e_2(n)x_2(n) \quad \text{[Formula 7]}$$

Respective variables in [Formula 7] represent the following.

n: sampling time

G(k): a filter coefficient set in the FIR filter 221 at a sampling time k $\mu_1$, $\mu_2$: a predetermined value of a weighting factor for updating$x_1(n)$: an output vector of the first transfer function simulation filter 234 at the sampling time n, the number of the output vector elements being the same as the number of taps of G $x_2(n)$: an output vector of the second transfer function simulation filter 235 at the sampling time n, the number of the output vector elements being the same as the number of taps of G Accordingly, as shown in [Formula 8], when the output from the second detection microphone 232 and the output from the subtractor 237 are small enough and the filter coefficient of the FIR filter 221 has converged, in the region 301, a synthesized sound of a radiated sound from the speaker 150 generated in accordance with a reference signal and a radiated sound from the active noise control device 200*a* generated in accordance with the reference signal has substantially the same characteristic as that applied to the desired characteristic simulation filter 236. As shown in [Formula 9], in the region 303, the radiated sound from the speaker 150 generated in accordance with the reference signal is cancelled by the radiated sound from the active noise control device 200*a* generated in accordance with the reference signal.

$$H_1-GC_1=H_1-(H_1-T)=T \quad \text{[Formula 8]}$$

$$H_2-GC_2=0 \quad \text{[Formula 9]}$$

Respective variables in [Formula 8] and [Formula 9] represent the following.

G: the filter coefficient set in the FIR filter 221 when [Formula 7] has converged.

$C_1$: the transfer function between an input to the vibrator 272 and an output from the first detection microphone 231

$C_2$: the transfer function between an input to the vibrator 272 and an output from the second detection microphone 232

$H_1$: the transfer function between an input to the speaker 150 and an output from the first detection microphone 231

$H_2$: the transfer function between an input to the speaker 150 and an output from the second detection microphone 232

T: the transfer function of a desired characteristic

For the filter coefficient of the FIR filter 221 in FIG. 3, a filter coefficient that has converged at the FIR filter 221 in FIG. 7 is set. By setting the control parameters of the control section 220*a* in this manner, in the region 301 in FIG. 2, the synthesized sound has a characteristic close to the above-described desired characteristic, and in the region 303 in FIG. 2, the sound radiated from the speaker 150 is cancelled by the sound radiated from the active noise control device 200.

Next, an influence on the convergence of G in [Formula 7] exerted by the relationship between the phase of a sound radiated from the speaker 150 and the phase of a sound radiated from the active noise control device 200 will be described. As described above, when two sound sources that radiate low-frequency sounds are positioned close to each other, it is extremely difficult to decrease the sound pressure level at a predetermined position and simultaneously increase the sound pressure level at the other different position. In other words, in the Filtered-X LMS algorithm represented by [Formula 7], it is difficult for G to converge, and even if G has converged, the control adjusted by the coefficient that has converged has a low accuracy.

However, in the configuration in FIG. 2, as shown in FIG. 5, the sound radiated from the active noise control device 200 toward the region 301 is in opposite phase to that toward the region 303. Accordingly, even when the two sound sources are positioned close to each other, it is quite possible to adjust the control parameters so as to decrease the sound pressure level at the predetermined position and simultaneously increase the sound pressure level at the other different position.

Figure 8:
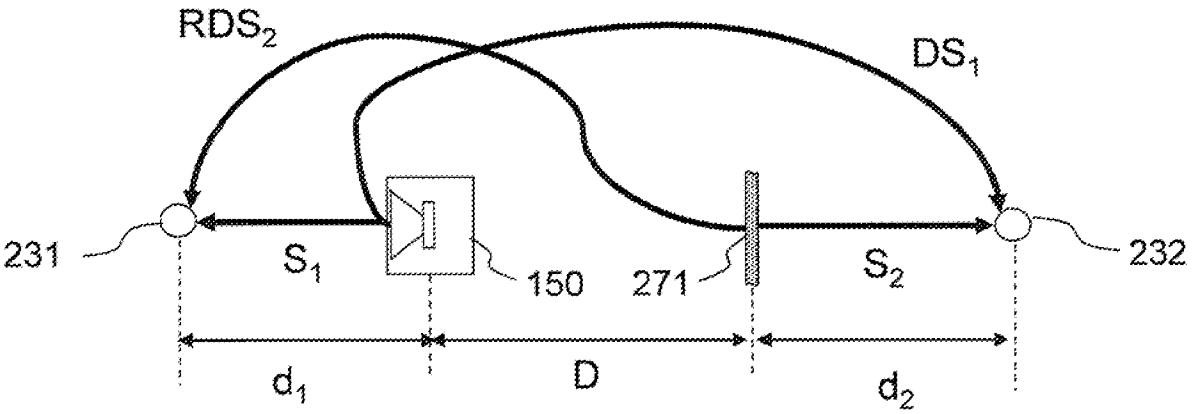
FIG. 8 illustrates an example where each of the speaker 150 and a diaphragm 271 radiates a low-frequency sound and each radiated low-frequency sound is propagated to both of a first detection microphone 231 and a second detection microphone 232.

FIG. 8 is a diagram for explaining this reason in detail. In FIG. 8, the speaker 150 radiates a low-frequency sound and the radiated sound expands in all directions to be propagated to both of the first detection microphone 231 and the second detection microphone 232. The diaphragm 271 radiates a low-frequency sound such that the radiated sound toward the first detection microphone 231 is in opposite phase to that toward the second detection microphone 232. The respective radiated sounds are propagated to both the first detection microphone 231 and the second detection microphone 232. The reference numerals in FIG. 8 represent the following.

$S_1$: an acoustic wave propagated to the first detection microphone 231 from the speaker 150

$S_2$: an acoustic wave propagated to the second detection microphone 232 from the diaphragm 271

$DS_1$: an acoustic wave propagated to the second detection microphone from the speaker 150

$RDS_2$: an acoustic wave propagated to the first detection microphone 231 from the diaphragm 271

D: the distance between the speaker 150 and the diaphragm 271

$d_1$: the distance between the speaker 150 and the first detection microphone 231 (the propagation path length of the acoustic wave $S_1$)

$d_2$: the distance between the diaphragm 271 and the second detection microphone 232 (the propagation path length of the acoustic wave $S_2$)

Figure 30:
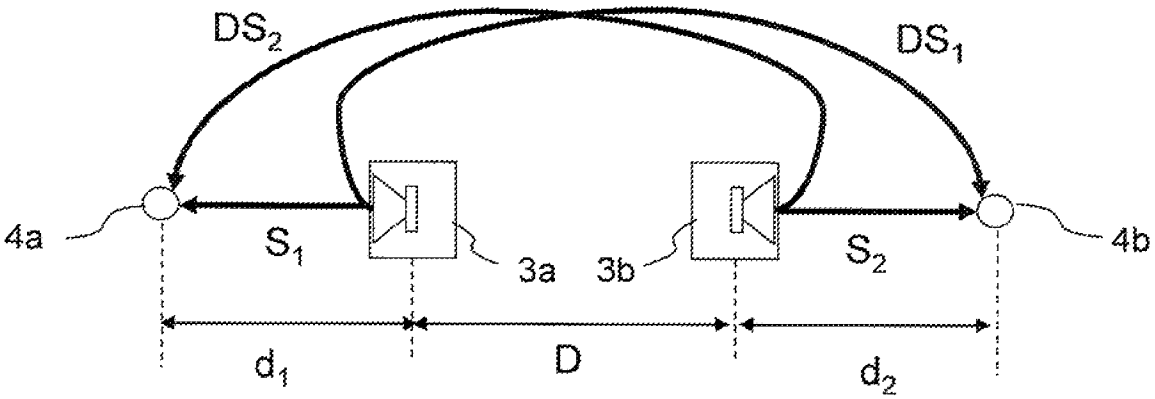
FIG. 30 illustrates an example where each of a first sound source 3*a* and a second sound source 3*b* radiates a low-frequency sound and each radiated low-frequency sound is propagated to both of a first detector 4*a* and a second detector 4*b*.

For convenience of description, it is assumed that $d_1$ and $d_2$ are equal to the same distance d as described in FIG. 30.

The intensity of the acoustic wave $S_1$ detected by the first detection microphone 231 is denoted by $I_1$; the intensity of the acoustic wave $S_2$ detected by the second detection microphone 232 is denoted by $I_2$; the intensity of the acoustic wave $DS_1$ detected by the second detection microphone 232 is denoted by $DI_1$; the intensity of the acoustic wave $RDS_2$ detected by the first detection microphone 231 is denoted by $DI_2$; and the intensity of the desired acoustic wave at the position of the first detection microphone 231 is denoted by I. In addition, the propagation path length of the acoustic wave $DS_1$ is denoted by $L_1$, and the propagation path length of the acoustic wave $RDS_2$ is denoted by $L_2$. In the space shown in FIG. 8, when the acoustic wave propagation characteristic is uniform, the path length of the acoustic wave $DS_1$ and that of the acoustic wave $RDS_2$ are substantially the same. In this situation, $L_1$ and $L_2$ are denoted by L.

In the above situation, the above-described relational equations [Formula 1] to [Formula 3] are satisfied. Suppose that the diaphragm 271 radiates the acoustic wave $S_2$ that cancels the acoustic wave $DS_1$ at the position of the second detection microphone 232. In this case also, the difference in path length between the acoustic wave $DS_1$ and the acoustic wave $S_2$ is equal to that between the acoustic wave $RDS_2$ and the acoustic wave $S_1$. However, because the acoustic wave $RDS_2$ is in opposite phase to the acoustic wave $S_2$, the acoustic wave $S_1$ and the acoustic wave $RDS_2$ are in phase at the position of the first detection microphone 231. Thus, the intensity Ir of the acoustic wave detected by the first detection microphone 231 is represented by the following [Formula 10] using [Formula 2] and [Formula 3].

$$I_r=I_1+DI_2=I_1+\delta^2\cdot I_1=(1+\delta^2)\cdot I_1 \quad \text{[Formula 10]}$$

Accordingly, in order for this Ir to be the desired intensity I, $I_1$ may be a value represented by the following [Formula 11].

$$I_1=\frac{I}{1+\delta^2} \quad \text{[Formula 11]}$$

Accordingly, even if δ varies depending on the distance D between the speaker 150 and the diaphragm 271, $I_1$ can be obtained as a value below I. In other words, in the LMS algorithm shown in [Formula 7], G can easily converge, resulting in the highly accurate control adjusted by the coefficient that has converged.

Figure 9:
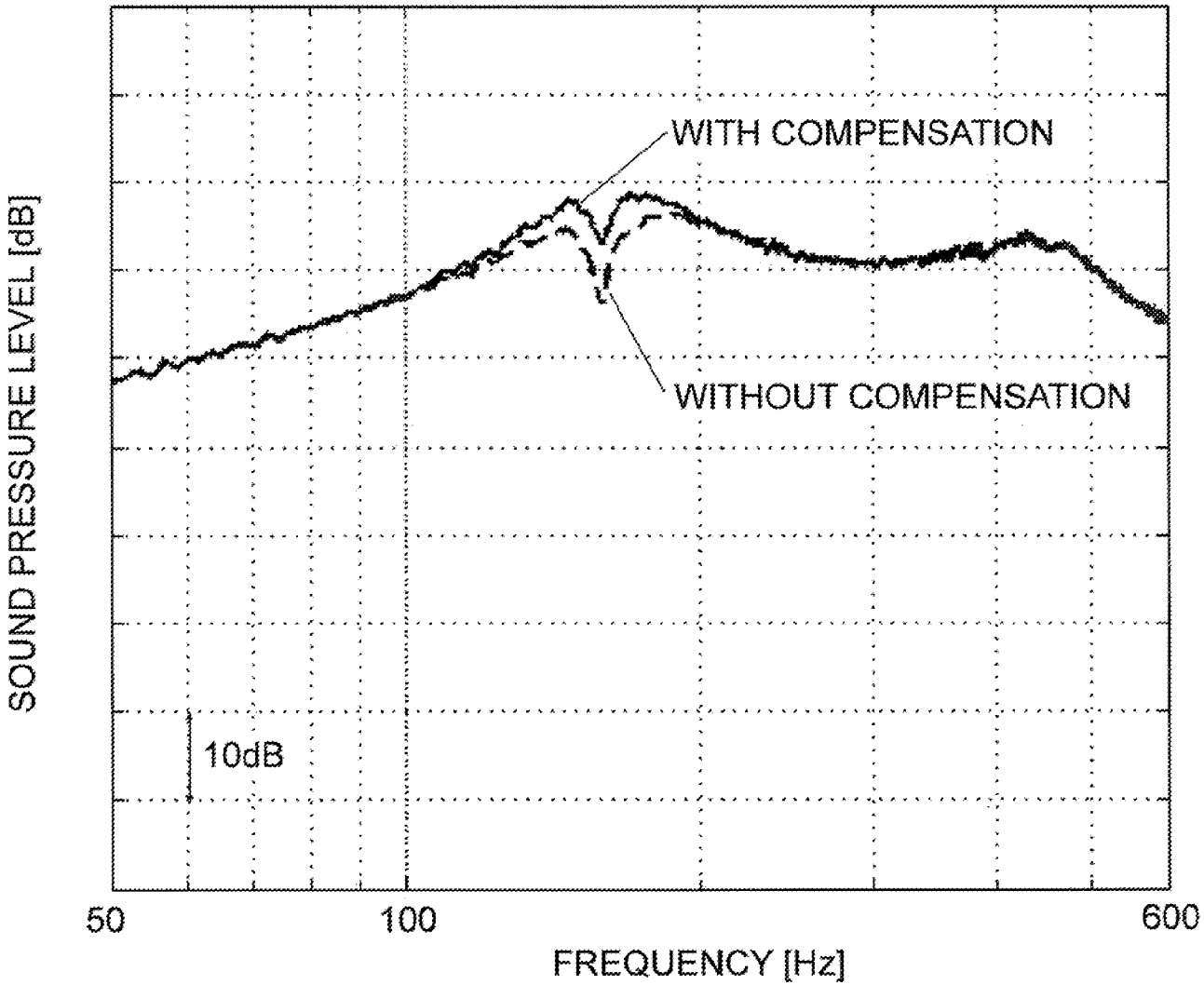
FIG. 9 illustrates change in a characteristic of a sound detected by the first detection microphone 231 due to an operation of the active noise control device 200*a* according to the first embodiment of the present invention.
Figure 10:
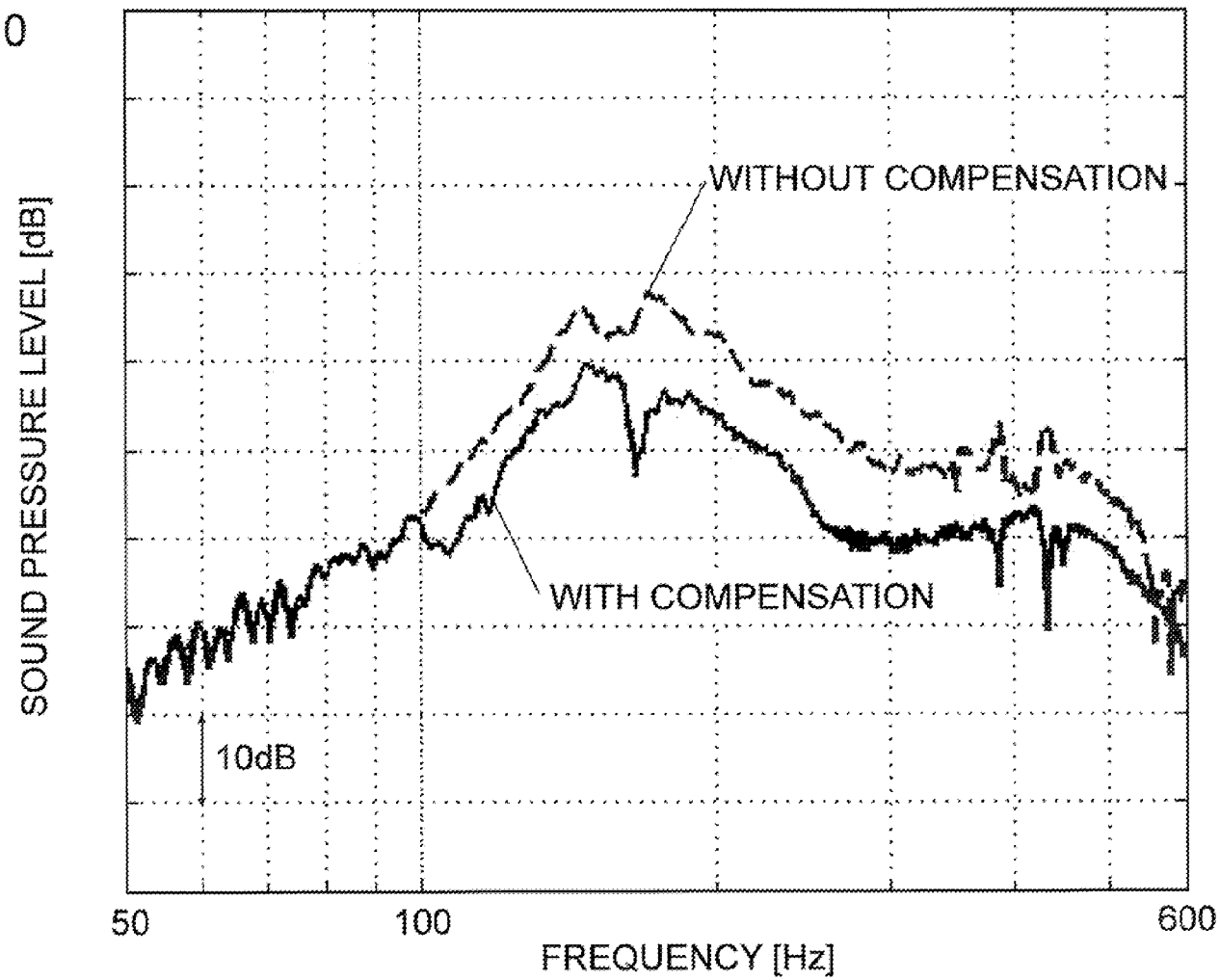
FIG. 10 illustrates change in a characteristic of sound detected by the second detection microphone 232 due to the operation of the active noise control device 200*a* according to the first embodiment of the present invention.

Next, the effects of the present invention will be described. FIG. 9 and FIG. 10 illustrate an example of measurement results of the sound pressure level detected by the first detection microphone 231 and the second detection microphone 232, respectively, in the case where the active noise control device 200*a* in FIG. 6 has executed control and the case where it has not executed control. In these examples, a target characteristic is given for the desired characteristic simulation filter 236, so that the level of a low-frequency component (100 to 200 Hz) increases by 6 dB in the region 301. FIG. 9 illustrates that the sound pressure level of a low-frequency component (100 to 200 Hz) increases in the region 301, while FIG. 10 illustrates that the sound pressure level of a low-frequency component (100 to 600 Hz) decreases in the region 303. Accordingly, the active noise control device 200*a* can improve a sound radiated from the speaker 150 so that the sound has a desired characteristic having an increased sound pressure level of a low-frequency component in a specific region, and simultaneously cancel the sound radiated from the speaker 150 in another region.

The first detection microphone 231 and the second detection microphone 232 in FIG. 6 may be attached to the control section 220*a* only while control parameters are being set based on an operation of the control parameter setting section 230, and may be removed later. Alternatively, the first detection microphone 231 and the second detection microphone 232 may remain attached to the control section 220*a* so as to continuously operate the control parameter setting section 230 to update the control parameters.

Alternatively, the active noise control device 200*a* of the present invention may includes, instead of the second detection microphone 232, a vibration detecting section that detects vibration of the boundary wall 300 and, outputs the detected vibration as an electric signal. In this case, the control parameter setting section 230 receives, instead of an output from the second detection microphone 232, an output from the vibration detecting section and sets the control parameters. This is because the vibration of the boundary wall 300 has a high correlation with the sound pressure in the region 303 since an acoustic wave from the region 303 excites the vibration of the boundary wall 300.

Figure 11:
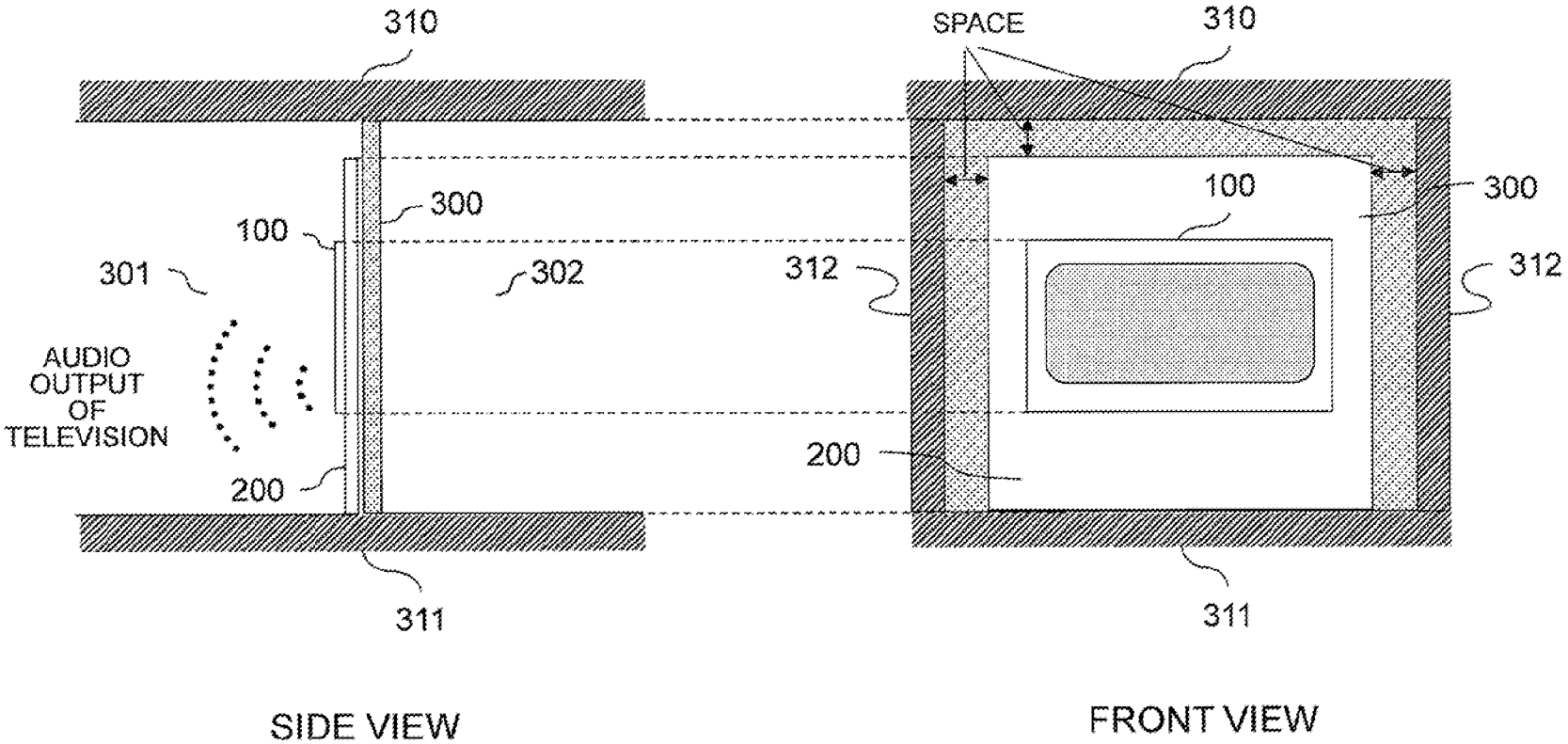
FIG. 11 illustrates an arrangement example of an active noise control device according to the first embodiment of the present invention.

The configuration of the active noise control device 200 according to the present invention is not limited to that shown in FIG. 1 and FIG. 2 where the diaphragm 271 is configured such that the region 303 is enclosed by the diaphragm 271, the ceiling 310, the floor surface 311, and the side walls 312. Even if space is provided between the diaphragm 271 and each of the ceiling 310, the floor surface 311, and the side walls 312 as shown in FIG. 11, for example, such that the gap 303 is not a completely enclosed space, the active noise control device 200 can decrease the sound pressure level of a low-frequency component in the gap 303. However, because the gap 303 is not a uniform acoustic field, the active noise control device 200 needs to control a plurality of points of the diaphragm 271 in order to control the entire acoustic field of the region 303. Accordingly, the active noise control device 200 needs to include a plurality of vibrating sections 270. Consequently, for simplification of the configuration of the active noise control device 200, it is preferable that the gap 303, which is formed by the diaphragm 271, the boundary wall 300, the ceiling 310, the floor surface 311, and the side walls 312, is a substantially enclosed space.

Figure 12:
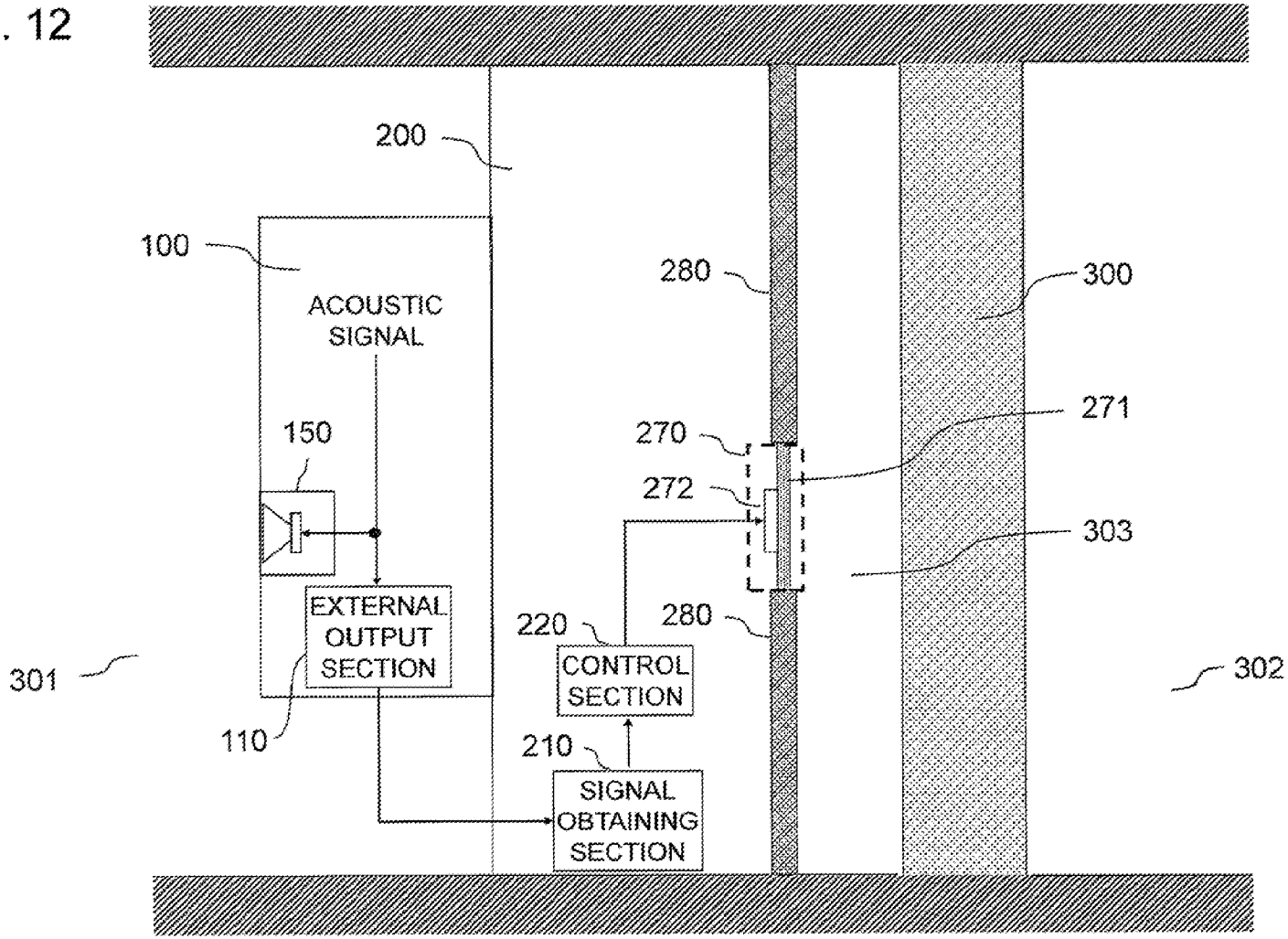
FIG. 12 illustrates an example of an internal configuration of the television 100 and the active noise control device 200 according to a modification of the first embodiment of the present invention.

Alternatively, the active noise control device 200 may be configured, as shown in FIG. 12, so as to include a baffle plate 280 that has an opening portion of the shape of the diaphragm 271 that is downsized, and the downsized diaphragm 271 attached to the opening portion. In this configuration, the area in the diaphragm 271 to be vibrated by the vibrator 272 is reduced, and thus a small piezoelectric element or the like can be used as the vibrator 272, and the level of amplification of a control signal also can be suppressed. Because the baffle plate 280 prevents diffraction of a radiated low-frequency sound, each of a sound radiated from the active noise control device 200 toward the region 301 and that toward the region 303 neither diffracts nor cancels the other.

Figure 13:
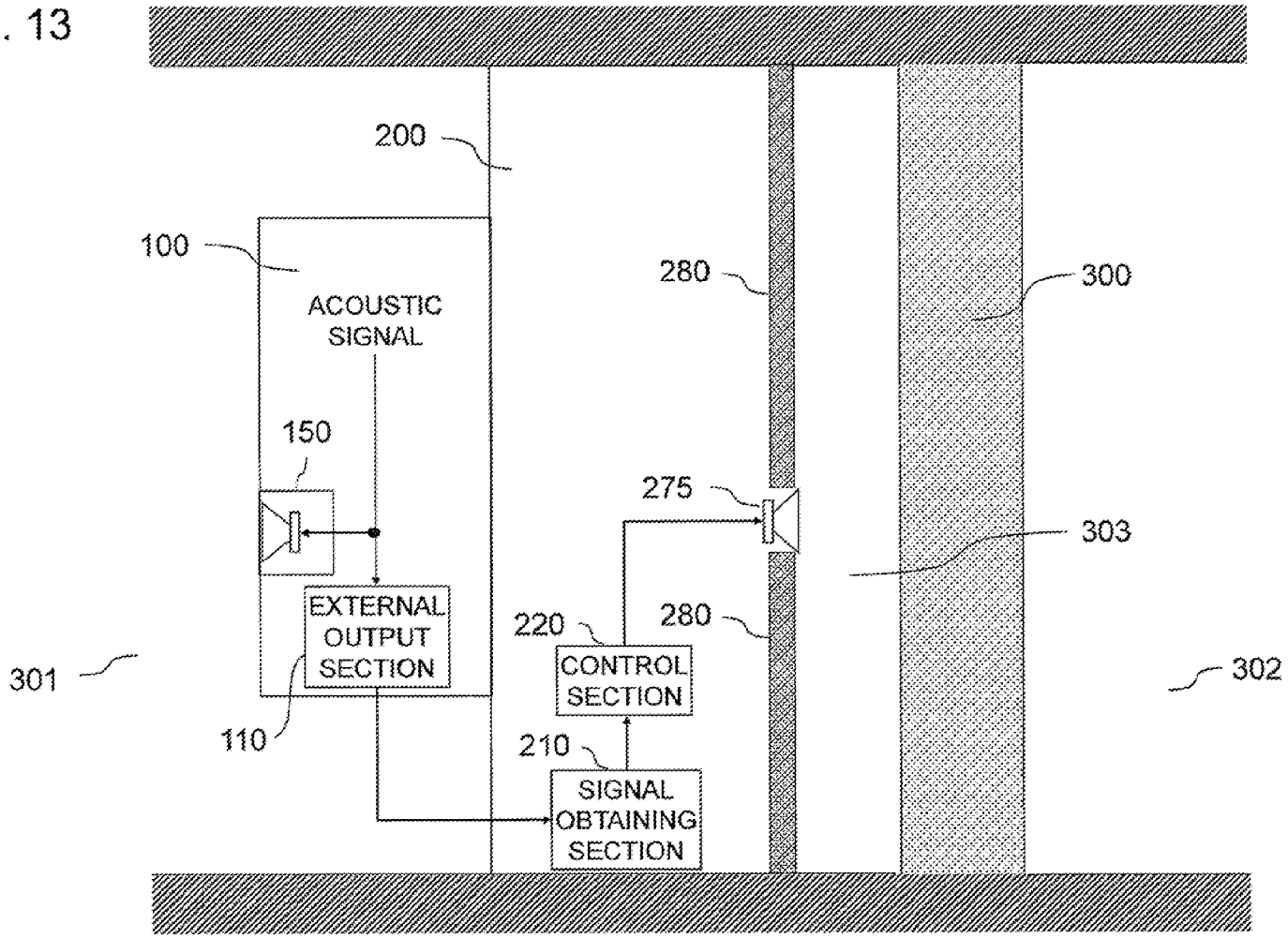
FIG. 13 illustrates an example of an internal configuration of the television 100 and the active noise control device 200 according to another modification of the first embodiment of the present invention.

As shown in FIG. 13, the vibrating section 270 may include, instead of the diaphragm 271 and the vibrator 272 in FIG. 12, a speaker unit 275. Not having a speaker box that prevents leakage of a sound in opposite phase, the speaker unit can realize the same effects as those of the present invention, unlike a normal speaker.

With the above-described configuration, by using a widely used device such as a speaker unit or a piezoelectric element, the device cost can be reduced without impairing the effects of the present invention.

Figure 14:
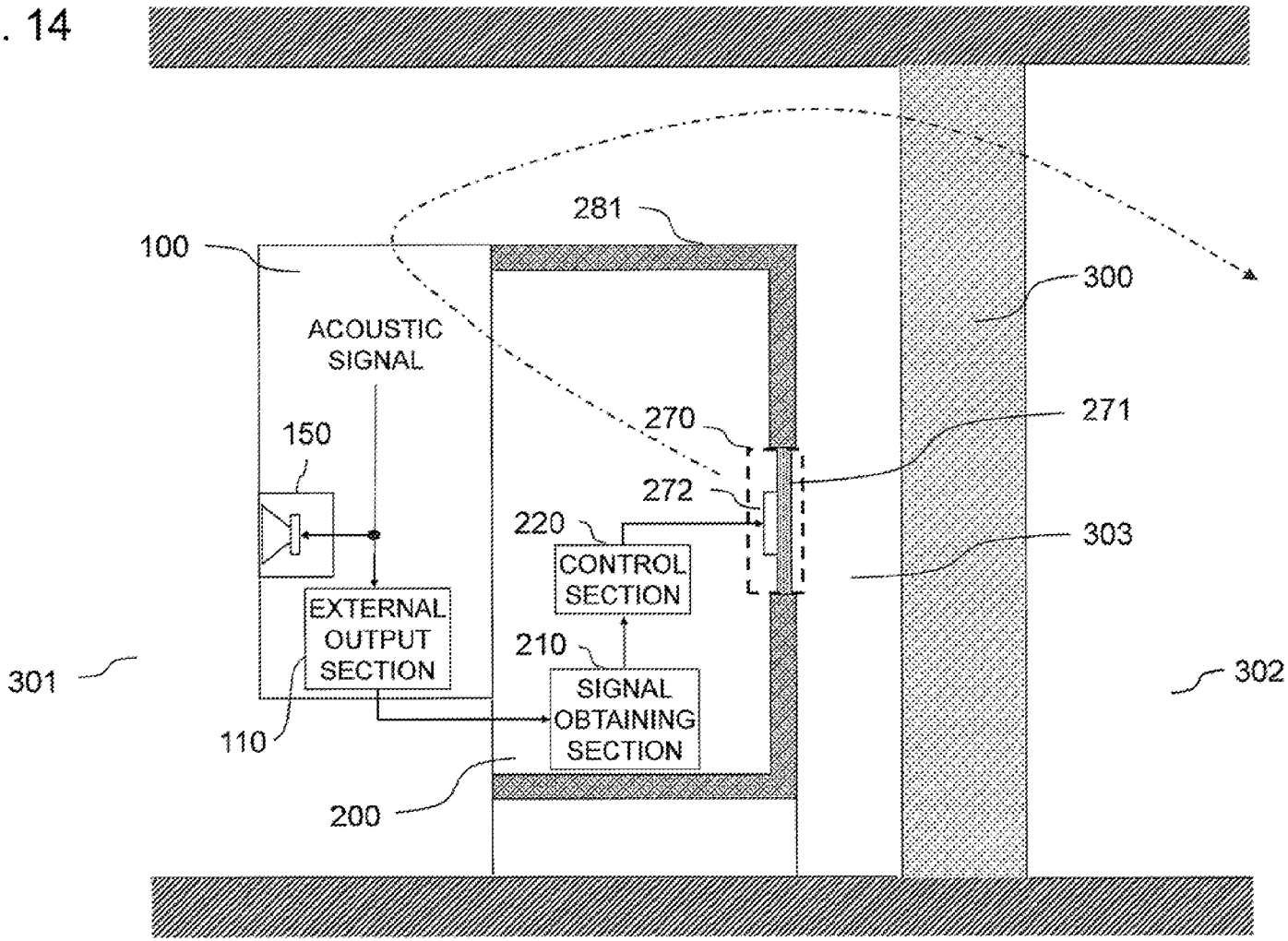
FIG. 14 illustrates an example of an internal configuration of the television 100 and the active noise control device 200 according to another modification of the first embodiment of the present invention.

As shown in FIG. 14, instead of the baffle plate 280, a box-shaped baffle plate 281 may be included, such that the baffle plate 281 covers a space to which a sound radiated toward the region 301 from the diaphragm 271 is propagated. In this configuration, because the sound radiated toward the region 301 from the diaphragm 271 is slightly diffracted toward the region 303 (a dashed-dotted line in FIG. 14), the effect of suppressing sound leakage is reduced. However, the area of a baffle structure is reduced, which can reduce a device cost.

Figure 15:
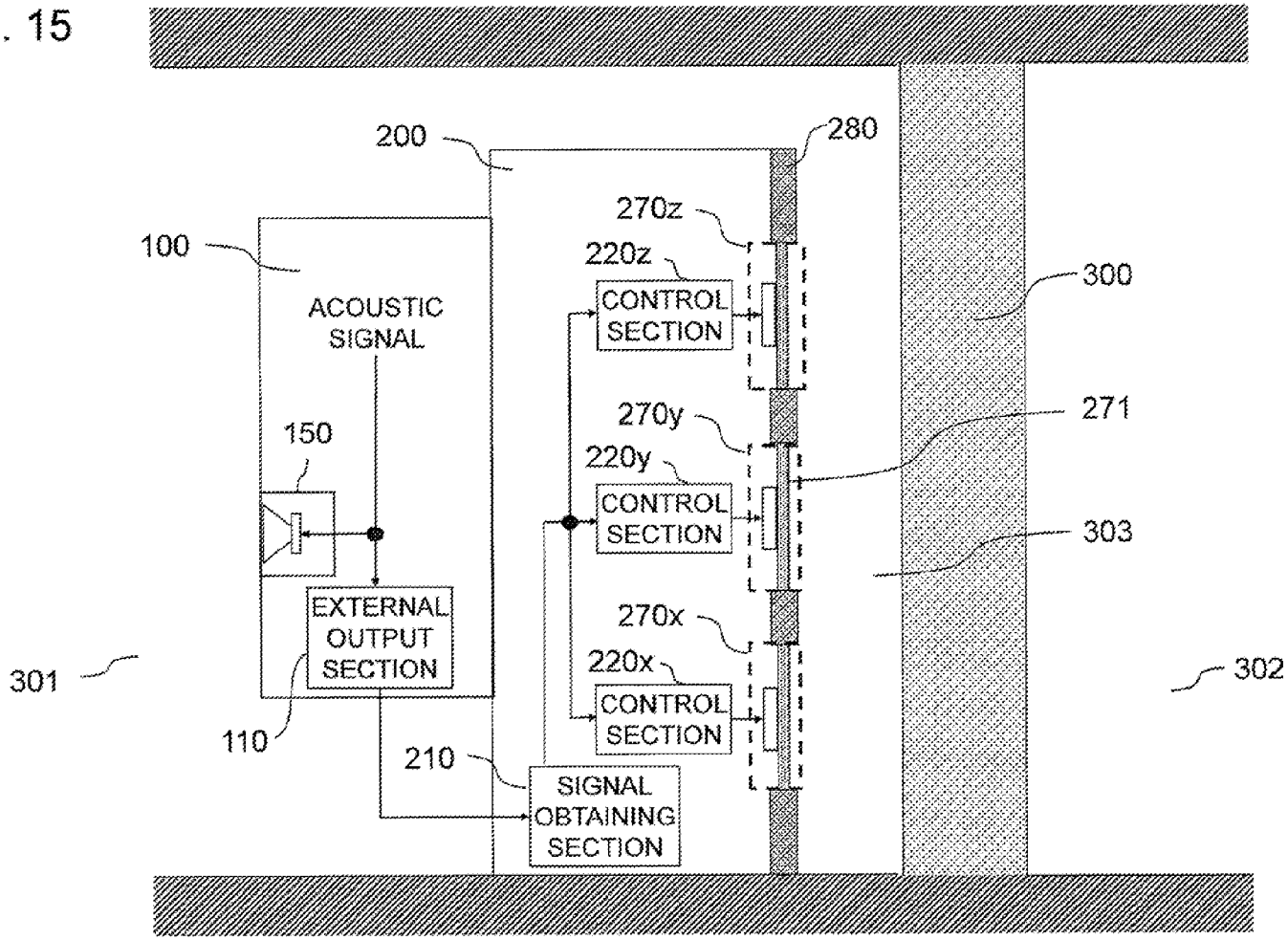
FIG. 15 illustrates an example of an internal configuration of the television 100 and the active noise control device 200 according to another modification of the first embodiment of the present invention.

Further, as shown in FIG. 15, a plurality of vibrating sections may be arranged along the boundary wall 300. In this case, control sections 220*x* to 220*z* are provided in accordance with the vibrating sections 270*x* to 270*z*, respectively. By such a configuration, even if the region 303 is not an enclosed space, a sound radiated from the speaker 150 can be cancelled in a wider range in the region 303, which can reduce sound leakage to the adjacent room 302.

Figure 16:
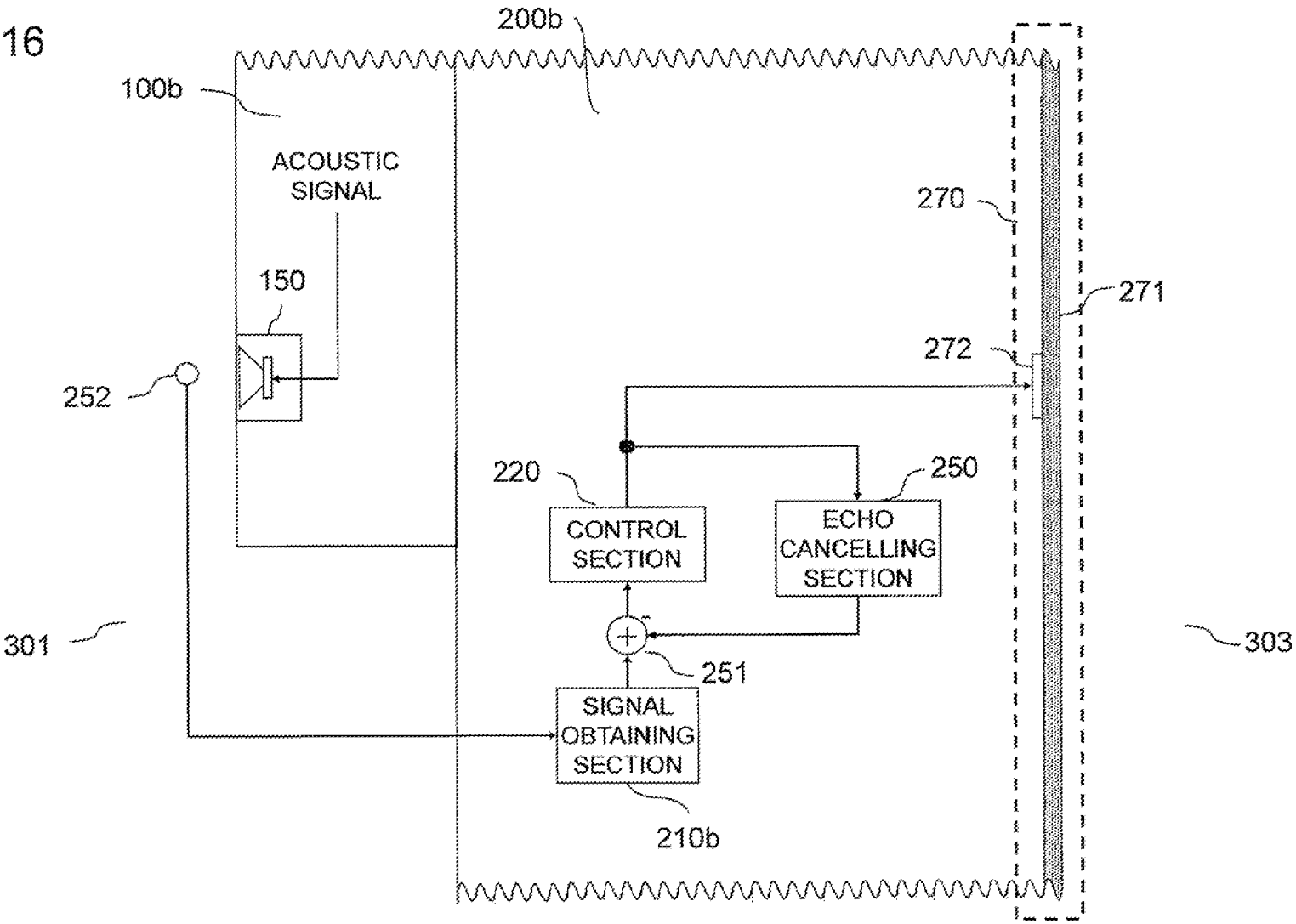
FIG. 16 illustrates an example of an internal configuration of a television 100*b* and an active noise control device 200*b* according to a modification of the first embodiment of the present invention.

The active noise control device 200 according to the present invention obtains an acoustic signal of a television from the external output section 110, and controls a sound radiated to the regions 301 to 303. However, even if the television does not include the external output section 110, the active noise control device can control the radiated sound in the same manner by including, in front of the speaker 150, a microphone that detects an audio output from the television. With reference to FIG. 16, such a modification of the first embodiment of the present invention will be described. FIG. 16 is a diagram illustrating an internal configuration of a television 100*b* that does not include the external output section 110, and an active noise control device 200*b*.

The active noise control device 200*b* includes a signal obtaining section 210*b*, the control section 220, the vibrating section 270, an echo cancelling section 250, a subtractor 251, and a signal detection microphone 252. Here, the components with the same reference numerals as those in FIG. 2 operate in the same manner as those in FIG. 2, and thus descriptions thereof are omitted. The signal detection microphone 252 is arranged close to the speaker 150, and detects a sound radiated from the speaker 150, and outputs the detected sound as an electric signal. The signal obtaining section 210*b* obtains the electric signal outputted from the signal detection microphone 252. The echo cancelling section 250 predicts, based on a control signal, an electric signal to be outputted afterward from the signal detection microphone 252 when the signal detection microphone 252 has detected a sound generated by the vibrating section 270. Then, the echo cancelling section 250 generates the predicted electric signal, as a pseudo echo signal. To this end, the echo cancelling section 250 is pre-designed to perform a process in accordance with the same characteristic as that of the transfer function between an input to the vibrator 272 and an output from the signal detection microphone 252. By processing the control signal from the control section 220 in accordance with the above-described characteristic, the echo cancelling section 250 generates the pseudo echo signal, and outputs the generated pseudo echo signal to the subtractor 251. The subtractor 251 subtracts the pseudo echo signal from an output signal of the signal obtaining section 210*b*, and outputs the resultant signal to the control section 220.

With the above-described configuration, the active noise control device 200*b* can realize the same operation as that of the active noise control device 200 even if the television does not include the external output section 110. Thus, the active noise control device 200*b* is applicable enough to existing televisions. Further, the active noise control device 200*b* can realize, regardless of the characteristic of an internal circuit of the television 100*b*, the same operation as that of the active noise control device 200. Operations of the echo cancelling section 250 and the subtractor 251 remove an echo, which arises when the signal detection microphone 252 picks up a sound that is generated by the vibrating section 270 in accordance with a control signal. Accordingly, there is no risk of dispersing an output from the control section 220 due to the echo.

The first detection microphone 231 in FIG. 6 and the signal detection microphone 252 in FIG. 16 may be provided behind or beside the speaker 150, or may be built in the television 100*b*. In such a case, the signal detection microphone 252 detects a synthesized sound of a diffracted sound of a sound radiated from the speaker 150, and a sound radiated toward the region 301 from the vibrating section 270. When an echo canceller is not required as in a case where a sound radiated from the vibrating section 270 is sufficiently smaller than a sound radiated from the speaker 150, the active noise control device 200*b* in FIG. 16 may not need to include the echo cancelling section 250 and the subtractor 251.

Figure 17:
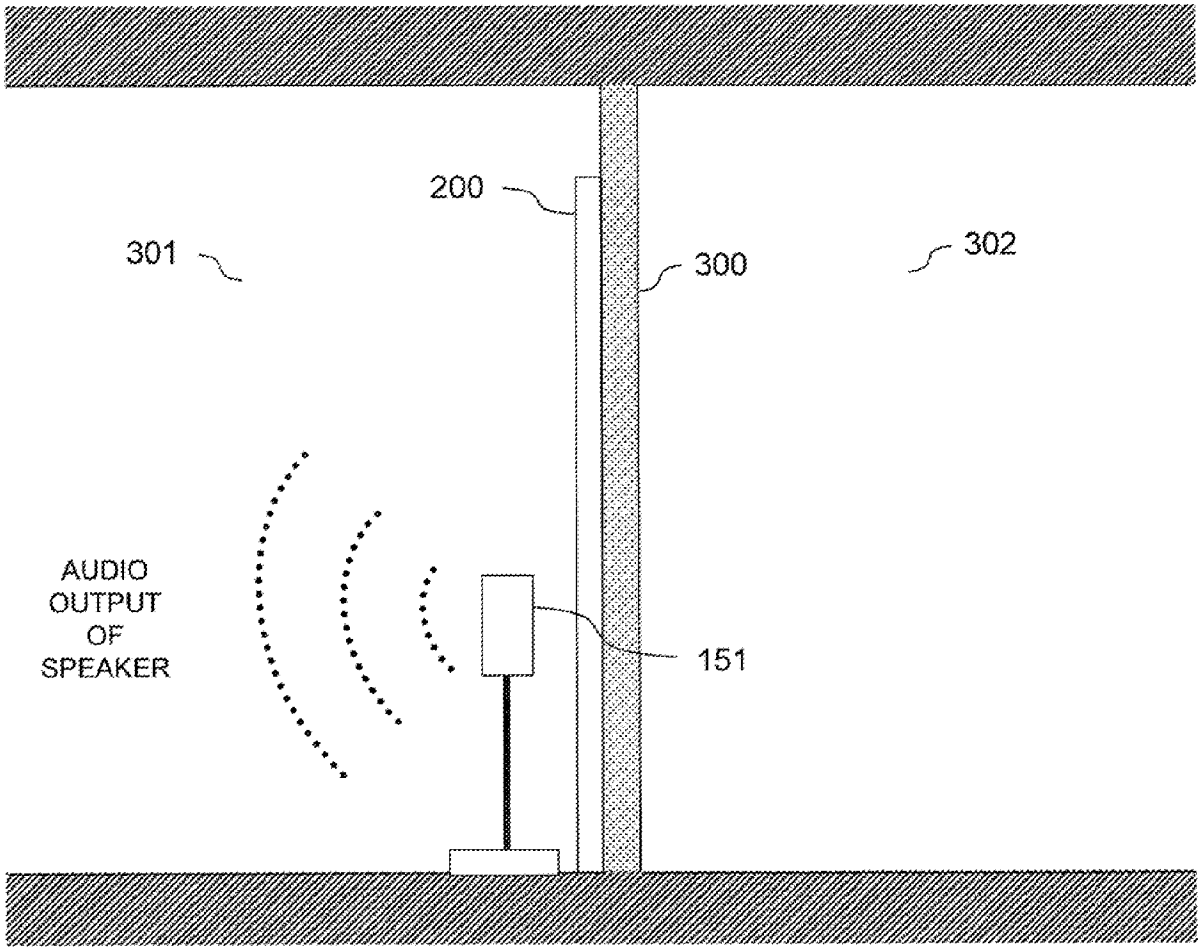
FIG. 17 illustrates an arrangement example of an active noise control device according to the first embodiment of the present invention.

The first embodiment of the present invention illustrates examples where the active noise control device 200 is applied to a television; however, the scope of application is not limited thereto. The present invention is also applicable for use in, for example, an audio system, a karaoke box, a conference hall, a wedding banquet hall, a school, and a preparatory school where it is preferable that sound leakage should be prevented in an adjacent room and audio should be improved so that the audio has a desired characteristic in a viewing room. FIG. 17 illustrates an application example for the above use. In an arrangement shown in FIG. 17, a speaker system 151, instead of the television 100, is arranged in front of the active noise control device 200. The speaker system 151 receives an acoustic signal from a content reproduction device, a microphone or the like that are not shown, and outputs audio or the like toward the region 301. At the same time, the active noise control device 200 receives the acoustic signal from the content reproduction device, the microphone or the like, and improves a sound radiated from the speaker system 151 so that the sound has a desired characteristic in the region 301, and simultaneously cancels the sound radiated from the speaker system 151 in the region 302.

(Second Embodiment)

Figure 18:
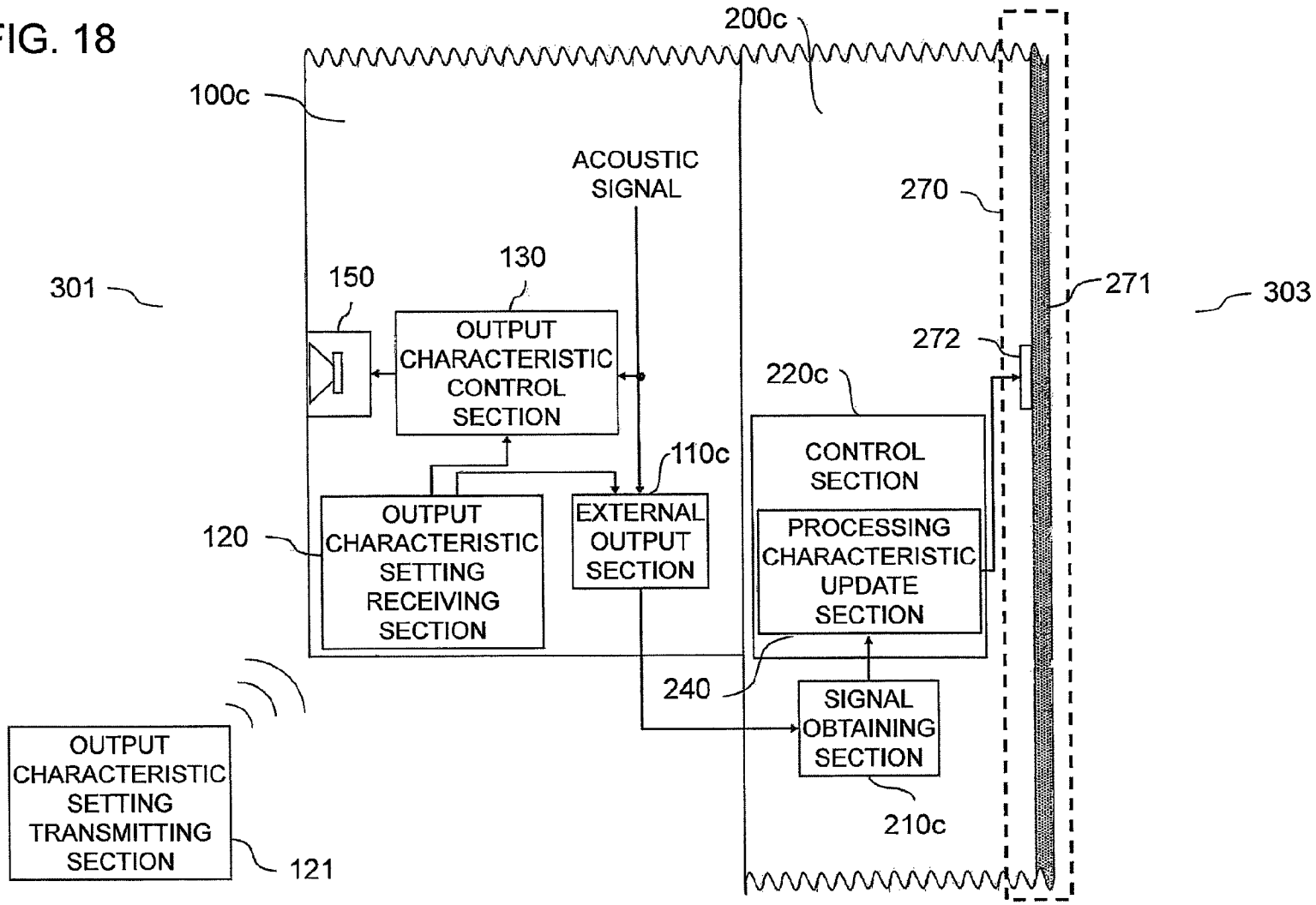
FIG. 18 illustrates an internal configuration of a television 100*c* and an active noise control device 200*c* according to a second embodiment of the present invention.

The first embodiment is based on the assumption that the signal same as an acoustic signal outputted to the speaker 150 or the like is obtained by the signal obtaining section 210 of the active noise control device 200. However, a normal television adjusts, in accordance with settings of volume, an equalizer, and the like made by a user, the acoustic output characteristic of an acoustic signal obtained from a broadcast wave or the like, and outputs the signal having the adjusted characteristic to the speaker 150 or the like. To this end, an active noise control device may have a configuration shown in the FIG. 18 so as to adjust the acoustic output characteristic of the acoustic signal. In FIG. 18, a television 100*c* includes an external output section 110*c*, an output characteristic setting receiving section 120, an output characteristic setting transmitting section 121, an output characteristic control section 130, and a speaker 150. An active noise control device 200*c* includes a signal obtaining section 210*c*, a control section 220*c*, and a vibrating section 270. Here, the components with the same reference numerals as those in FIG. 2 operate in the same manner as those in the first embodiment, and thus descriptions thereof are omitted.

The output characteristic setting transmitting section 121 transmits, to the television 100*c*, via wireless communication or infrared communication, a signal relating to an acoustic output characteristic set by the user. The output characteristic setting receiving section 120 receives the signal from the output characteristic setting transmitting section 121. The output characteristic control section 130 processes an acoustic signal, in accordance with the output characteristic setting included in the signal received by the output characteristic setting receiving section 120. The external output section 110*c* outputs, as an electric signal, not only the acoustic signal but also the signal received by the output characteristic setting receiving section 120. The signal obtaining section 210*c* obtains the signal outputted from the external output section 110*c* of the television 100*c*. With reference to the signal received by the output characteristic setting receiving section 120, the control section 220*c* generates a control signal that has an amplitude-phase characteristic appropriately corrected in accordance with an output characteristic of audio outputted from the speaker 150, and controls the vibrating section 270. The control section 220*c* will be described in detail below.

Figure 19:
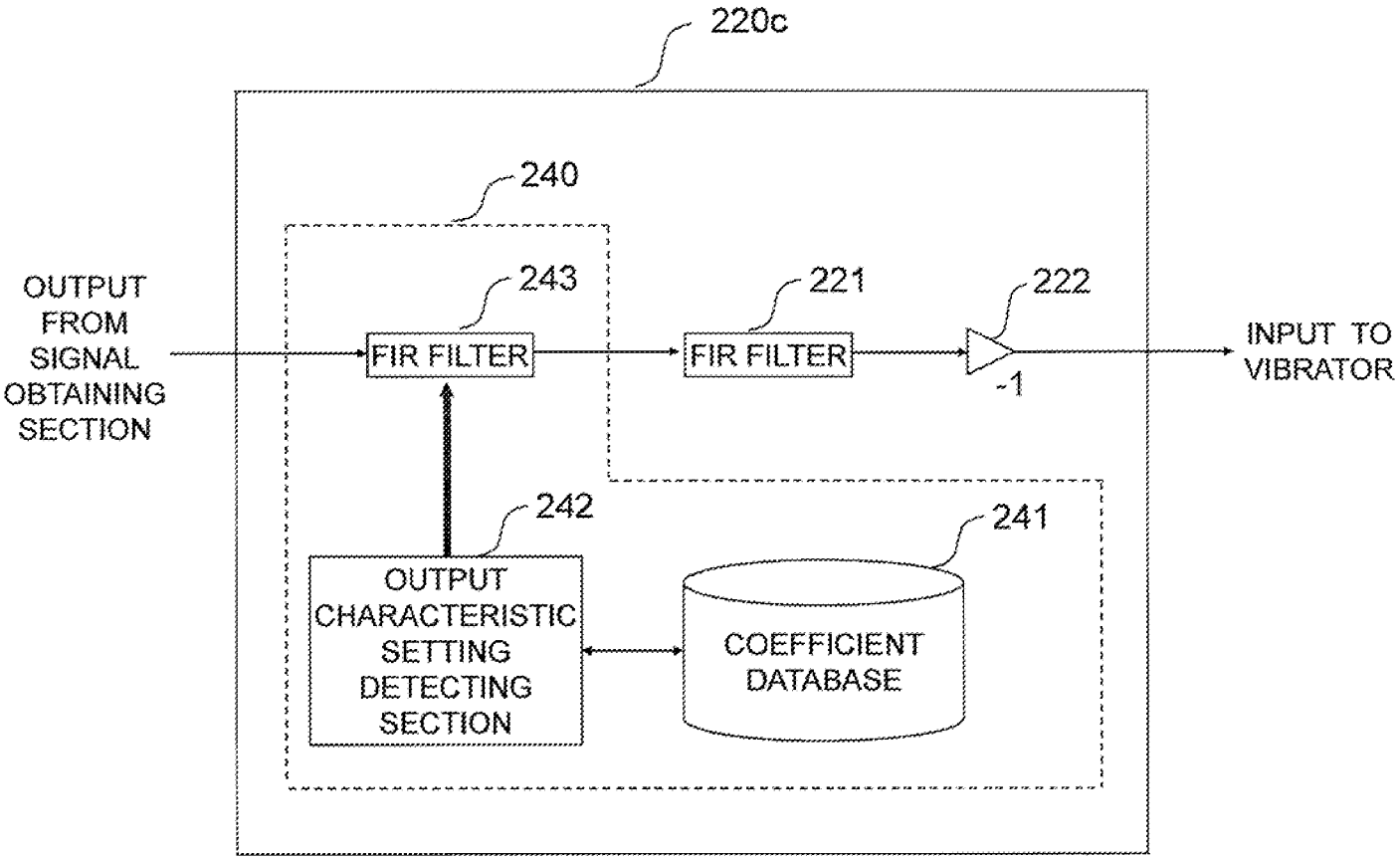
FIG. 19 illustrates an internal configuration of a control section 220*c* according to the second embodiment of the present invention.

FIG. 19 illustrates an internal configuration of the control section 220*c*. The control section 220*c* includes an FIR filter 221, a phase inverter 222, and a processing characteristic update section 240. The processing characteristic update section 240 includes a coefficient database 241, an output characteristic setting detecting section 242, and an FIR filter 243. The components with the same reference numerals as those in FIG. 3 operate in the same manner as those in the first embodiment, and thus descriptions thereof are omitted.

The coefficient database 241 stores the association between output characteristic settings and the corresponding filter coefficients of the output characteristic control section 130. The output characteristic setting detecting section 242 detects the signal received by the output characteristic setting receiving section 120, and obtains, from the coefficient database 241, a filter coefficient that corresponds to the output characteristic setting of the detected signal. Then, the output characteristic setting detecting section 242 sets the filter coefficient for the FIR filter 243. The FIR filter 243 previously processes a signal to be inputted to the FIR filter 221.

Next, with reference to FIG. 18 and FIG. 19, operations according to the second embodiment of the present invention will be described. The output characteristic setting transmitting section 121 transmits, to the television 100*c*, an output characteristic setting desired by the user. The output characteristic setting receiving section 120 receives a signal from the output characteristic setting transmitting section 121. And, in accordance with the output characteristic setting included in the received signal, the output characteristic setting section 120 sets the filter coefficient that is previously stored therein in the output characteristic control section 130. The output characteristic control section 130 processes the acoustic signal based on the set filter coefficient. Through the above-described process, the speaker 150 outputs a sound that has the characteristic desired by the user.

Meanwhile, the output characteristic setting detecting section 242 detects the signal received by the output characteristic setting receiving section 120, and obtains, from the coefficient database 241, a filter coefficient that corresponds to the output characteristic setting included in the received signal. Then, the output characteristic setting detecting section 242 sets the filter coefficient for the FIR filter 243. Accordingly, a signal that has the same output characteristic as that of the signal outputted from the speaker 150, is also inputted to the FIR filter 221. Thus, a correction effect in both the region 301 and the region 303 does not change.

Figure 20:
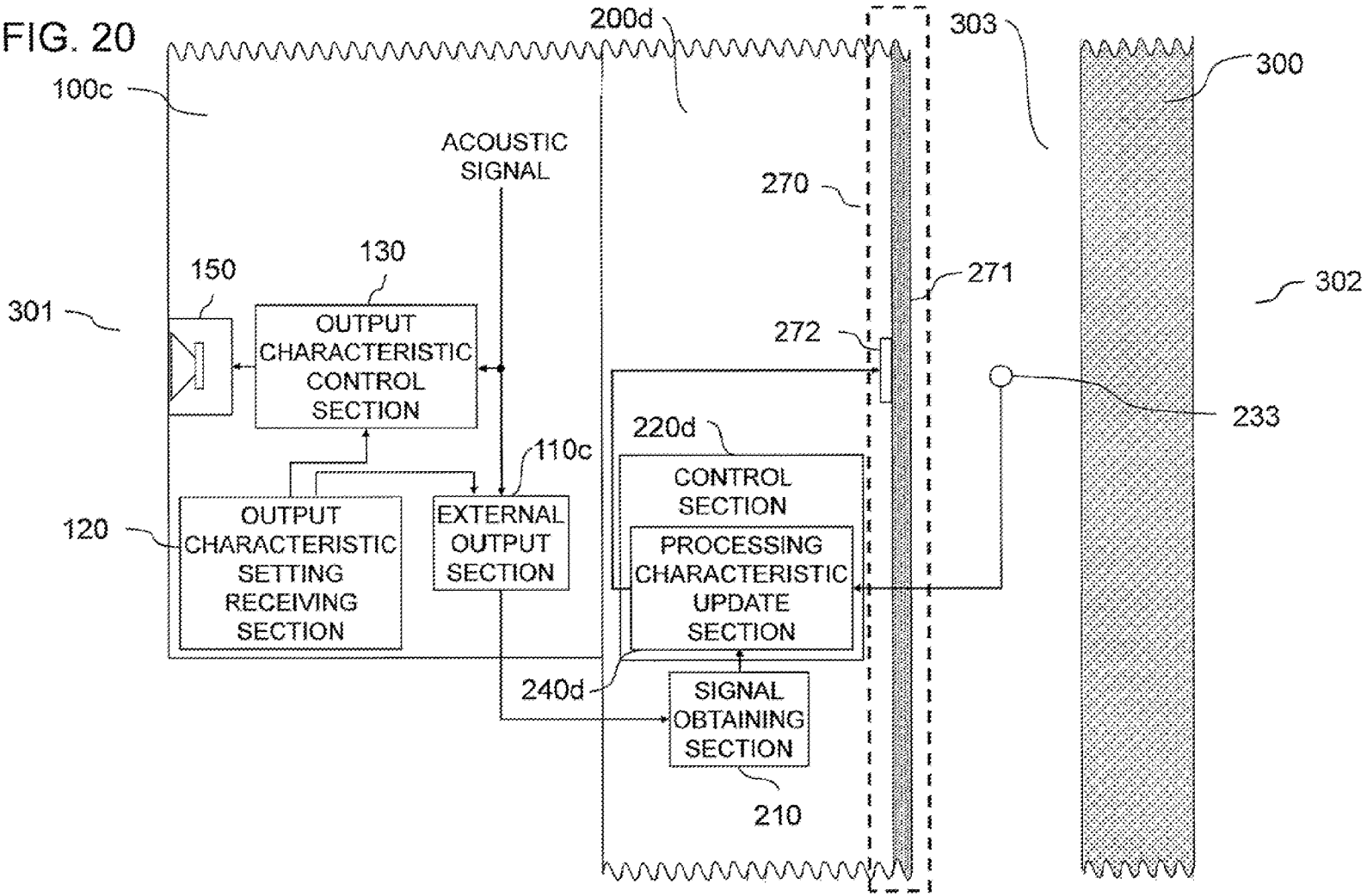
FIG. 20 illustrates an internal configuration of the television 100*c* and an active noise control device 200*d* according to a modification of the second embodiment of the present invention.
Figure 21:
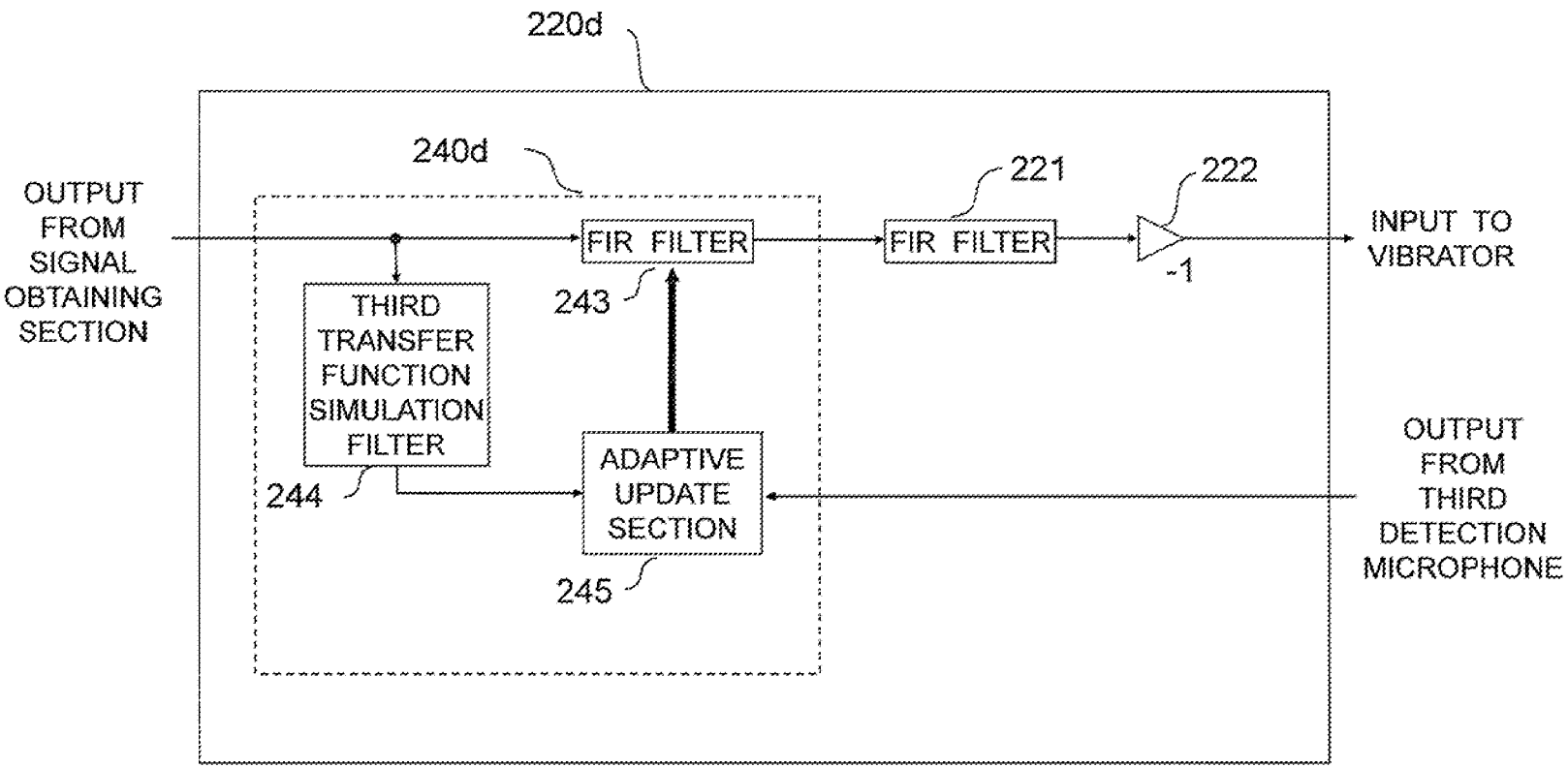
FIG. 21 illustrates an internal configuration of the control section 220*d* according to another modification of the second embodiment of the present invention.

In the configurations in FIG. 18 and FIG. 19, the association between output characteristic settings and the corresponding filter coefficients of the output characteristic control section 130 need to be previously stored in the coefficient database 241. However, without including the coefficient database 241, the active noise control device may realize a correction effect in both the region 301 and the region 303 by adapting to the output characteristic changes in real time. With reference to FIG. 20 and FIG. 21, a modification of the second embodiment of the present invention will be described. In FIG. 20, an active noise control device 200*d* includes the signal obtaining section 210, a control section 220*d*, a third detection microphone 233, and the vibrating section 270. The components with the same reference numerals as those in FIG. 6 and FIG. 18 operate in the same manner as those in FIG. 6 and FIG. 18, and thus descriptions thereof are omitted.

The third detection microphone 233 is arranged at the same position where the second detection microphone 232 is arranged in FIG. 6, and detects a synthesized sound of a sound radiated sound from the speaker 150 and a sound radiated from the active noise control device 200*d*, and outputs the detected synthesized sound as an electric signal. With reference to the synthesized sound detected by the third detection microphone 233, the control section 220*d* generates a control signal and controls the vibrating section 270 so that the sound radiated from the vibrating section 270 cancels the sound outputted from the speaker 150. Next, the control section 220*d* will be described in detail.

FIG. 21 illustrates an internal configuration of the control section 220*d*. The control section 220*d* includes the FIR filter 221, the phase inverter 222, and a processing characteristic update section 240*d*. The processing characteristic update section 240*d* includes the FIR filter 243, a third transfer function simulation filter 244, and an adaptive update section 245. Here, the components with the same reference numerals as those in FIG. 19 operate in the same manner as those in FIG. 19, and thus descriptions thereof are omitted.

The third transfer function simulation filter 244, which is an FIR filter, processes a signal obtained by the signal obtaining section 210. The adaptive update section 245 calculates an FIR filter coefficient by using an output from the third transfer function simulation filter 244 and an output from the third detection microphone 233. To the third transfer function simulation filter 244, an Fx obtained by the following [Formula 12] is given as a coefficient, the Fx being obtained by convolving a filter coefficient G obtained in the configurations in FIG. 6 and FIG. 7, and a transfer function impulse response $C_2$ between an input to the vibrator 272 and an output from the third detection microphone 233.

$$F_x = GC_2 \qquad \text{[Formula 12]}$$

Next, with reference to FIG. 20 and FIG. 21, an operation of a modification of the second embodiment of the present invention will be described. In the same manner as the configuration in FIG. 18, the speaker 150 outputs a sound that has the characteristic desired by the user, through the process of the output characteristic control section 130. Meanwhile, the vibrator 272 receives a signal, which has been processed by the FIR filter 243 having a predetermined initial coefficient, and which has subsequently been processed by the FIR filter 221 in which a filter coefficient calculated based on [Formula 7] had been set. Accordingly, a sound radiated toward the region 303 from the active noise control device 200*d* does not cancel a sound radiated from the speaker 150. Here, the adaptive update section 245 updates the filter coefficient of the FIR filter 243 so that the synthesized sound detected by the third detection microphone 233, which is the synthesized sound of the sound outputted from the speaker 150 and the sound radiated from the active noise control device 200*d*, becomes close to 0. When the filter coefficient of the FIR filter 243 has converged, the following formula is satisfied.

$$H_2\Delta H - GC_2\Delta G = 0 \quad \text{[Formula 13]}$$

Respective variables in [Formula 13] represent the following.

ΔG: the transfer function of the FIR filter 243

ΔH: the transfer function of the output characteristic control section 130 that corresponds to an output characteristic set by the user Here, based on [Formula 9] and [Formula 13], the following formula is satisfied.

$$\Delta G = \Delta H \quad \text{[Formula 14]}$$

Accordingly, the transfer function ($H_1\Delta H - GC_1\Delta G$) of the synthesized sound at the position of the first detection microphone 231 is obtained, as shown in the following formula, by multiplying a desired characteristic T having an increased sound pressure level of a low-frequency component by the characteristic ΔH set by the user.

$$H_1\Delta H - GC_1\Delta G = H_1\Delta H - (H_1 - T)\Delta G = H_1\Delta H - (H_1 - T)\Delta H = T\Delta H \quad \text{[Formula 15]}$$

Figure 22:
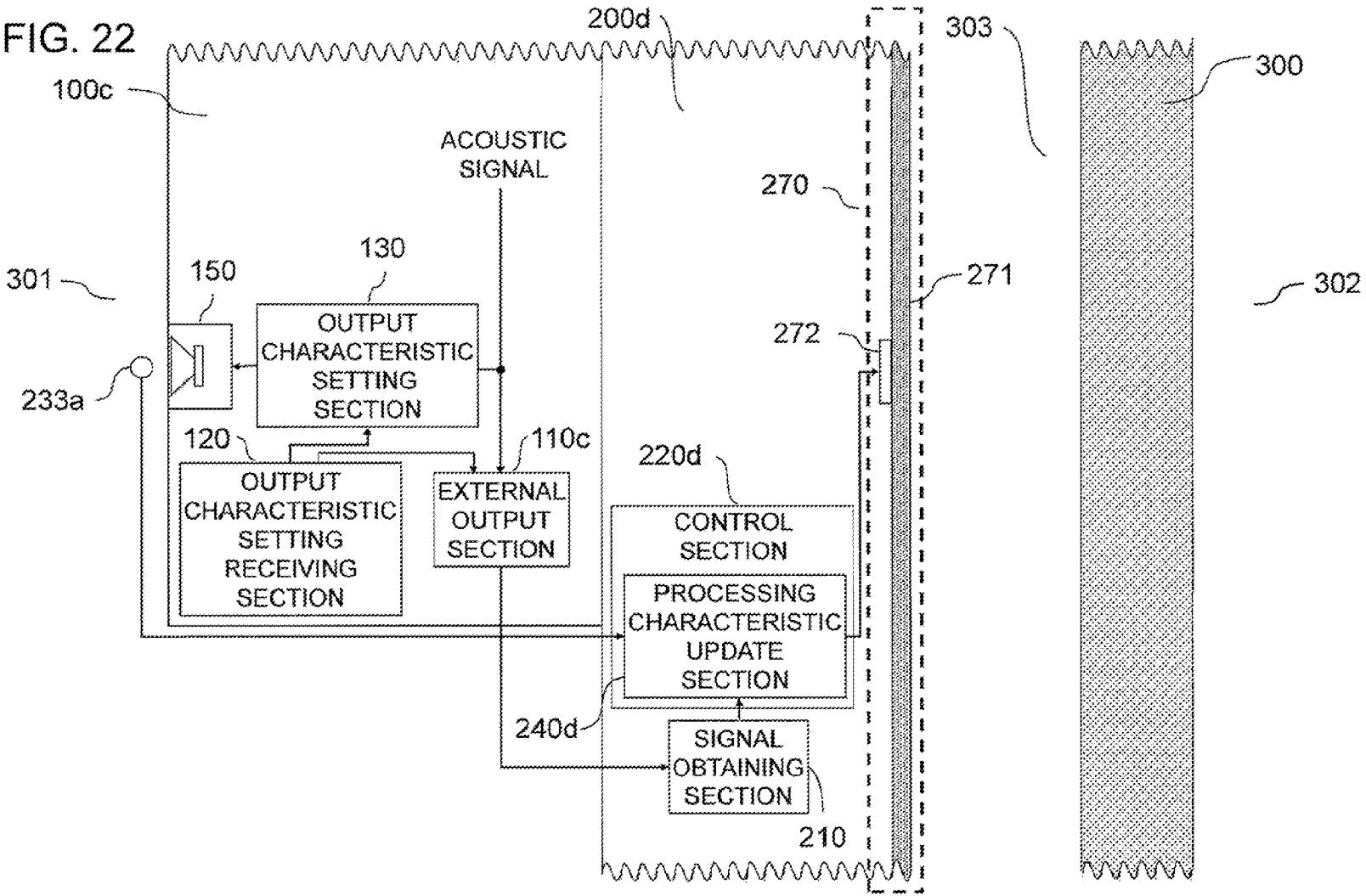
FIG. 22 illustrates an internal configuration of the television 100*c* and the active noise control device 200*d* according to another modification of the second embodiment of the present invention.
Figure 23:
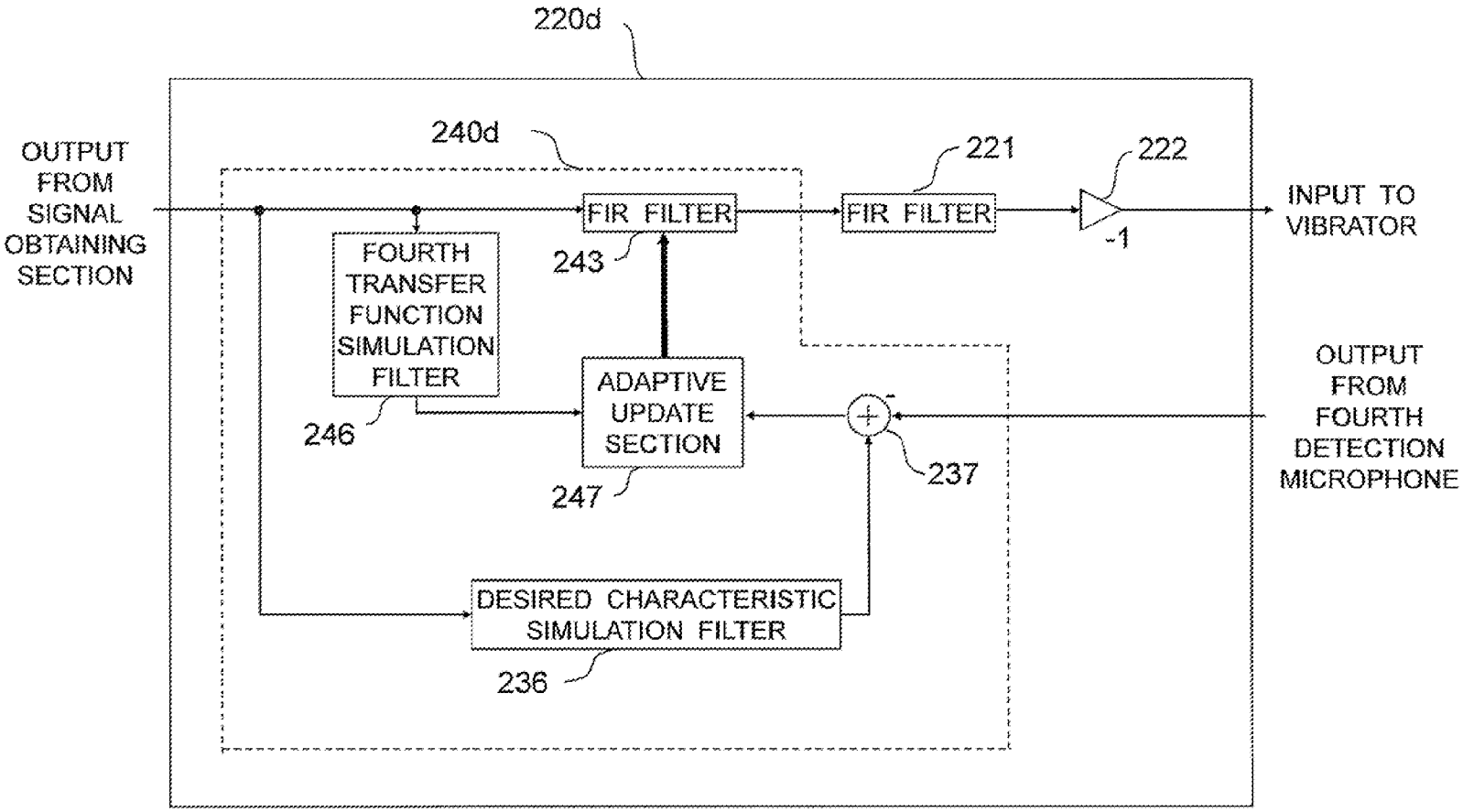
FIG. 23 illustrates an internal configuration of the control section 220*d* according to another modification of the second embodiment of the present invention.
Figure 24:
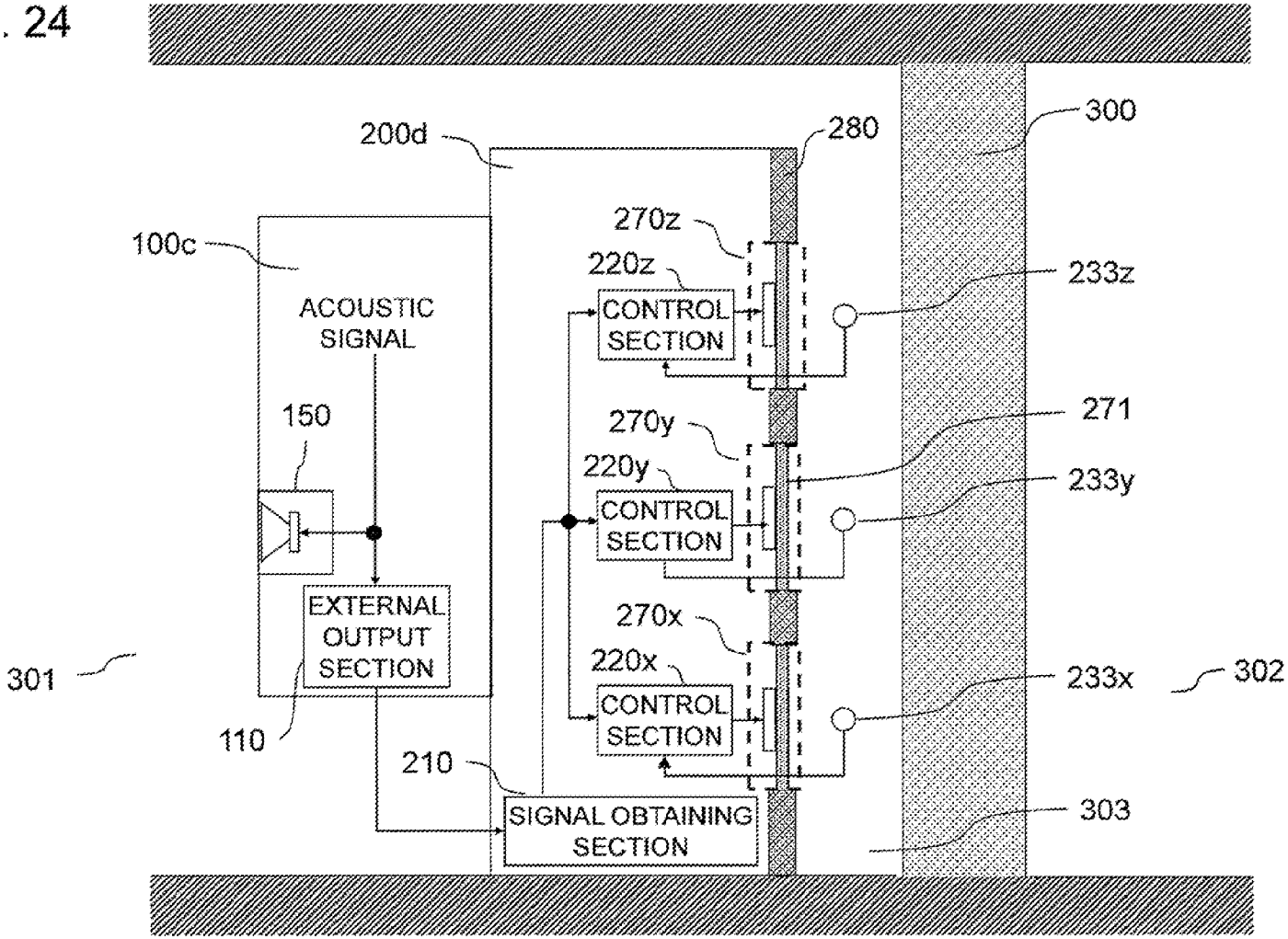
FIG. 24 illustrates an internal configuration of the television 100*c* and the active noise control device 200*d* according to another modification of the second embodiment of the present invention.

The active noise control device 200*d* according to the present invention may include, instead of the third detection microphone 233, a fourth detection microphone 233*a* which is arranged at the same position where the first detection microphone 231 is arranged, or close to the speaker 150, as shown in FIG. 22. In this case, with reference to the synthesized sound detected by the fourth detection microphone 233*a*, the control section 220*d* generates a control signal so that the sound outputted from the speaker 150 has a desired frequency characteristic, and controls the vibrating section 270. FIG. 23 illustrates an internal configuration of the control section 220*d*. The processing characteristic update section 240*d* includes the FIR filter 243, a fourth transfer function simulation filter 246, the desired characteristic simulation filter 236, the subtractor 237, and an adaptive update section 247. Here, the components with the same reference numerals as those in FIG. 7 and FIG. 21 operate in the same manner as those in FIG. 7 and FIG. 21, and thus descriptions thereof are omitted.

The fourth transfer function simulation filter, which is an FIR filter, processes a signal obtained by the signal obtaining section 210. To the fourth transfer function simulation filter 246, an Fx obtained by the following [Formula 16] is given as a filter coefficient, the Fx being obtained by convolving the filter coefficient G obtained in the configurations in FIG. 6 and FIG. 7, and the transfer function impulse response $C_1$ between an input to the vibrator 272 and an output from the fourth detection microphone 233.

$$F_x = GC_1 \quad \text{[Formula 16]}$$

The adaptive update section 247 updates the filter coefficient of the FIR filter 243 so that the synthesized sound detected by the third detection microphone 233*a*, which is the synthesized sound of the sound outputted from the speaker 150 and the sound radiated from the active noise control device 200*d*, has a characteristic close to a desired characteristic.

In the same manner as in the first embodiment, the active noise control device 200*d* of the present invention may include, instead of the third detection microphone 233, a vibration detecting section that detects vibration of a boundary wall 300 to output the detected vibration as an electric signal. In this case, the processing characteristic update section 240*d* receives, instead of an output from the third detection microphone 233, an output from the vibration detecting section and sets a filter coefficient for the FIR filter 243. To the third transfer function simulation filter 244, a filter coefficient is given, the coefficient being obtained by convolving a filter coefficient obtained in the configurations in FIG. 6 and FIG. 7, and a transfer function impulse response between an input to the vibrator 272 and an output from the vibration detecting section.

Alternatively, when a plurality of vibrating sections are arranged along the boundary wall 300 as shown in FIG. 15, the active noise control device 200*d* includes, in the region 303, third detection microphones 233*x* to 233*z* that correspond to the vibrating sections 270*x* to 270*z*, respectively. The filter coefficients of the FIR filters 243 of respective control sections 220*x* to 220*z* are updated so that sounds detected by the respective third detection microphones 233*x* to 233*z* are closer to 0.

Also in the second embodiment of the present invention, the active noise control device may include a baffle plate and a speaker unit shown in FIGS. 12 to 14. Alternatively, as show in FIG. 16, the active noise control device may include the signal detection microphone 252. The active noise control device according to the second embodiment of the present invention is applicable, as shown in FIG. 17, for use in an audio system or the like.

(Third Embodiment)

As shown in FIG. 5, the first and second embodiments are based on the assumption that the sound radiated from the diaphragm 271 toward the region 301 is in opposite phase to the sound radiated from the diaphragm 271 toward the region 303. However, depending on the configuration of an active noise control device, or the wall structure of a viewing room 301 and an adjacent room 302, when sounds of certain frequencies are radiated from the diaphragm 271, a sound radiated from the diaphragm 271 toward the region 301 and a sound radiated from the diaphragm 271 toward the region 303 may be in phase. In such a case, the sound radiated from the diaphragm 271 cannot increase the sound pressure level at low frequency in a space where a viewer stays and simultaneously decrease the sound pressure level at low frequency in the adjacent room. Therefore, in the third embodiment, the active noise control device controls the diaphragm 271 not to radiate a sound of such frequencies.

Figure 25:
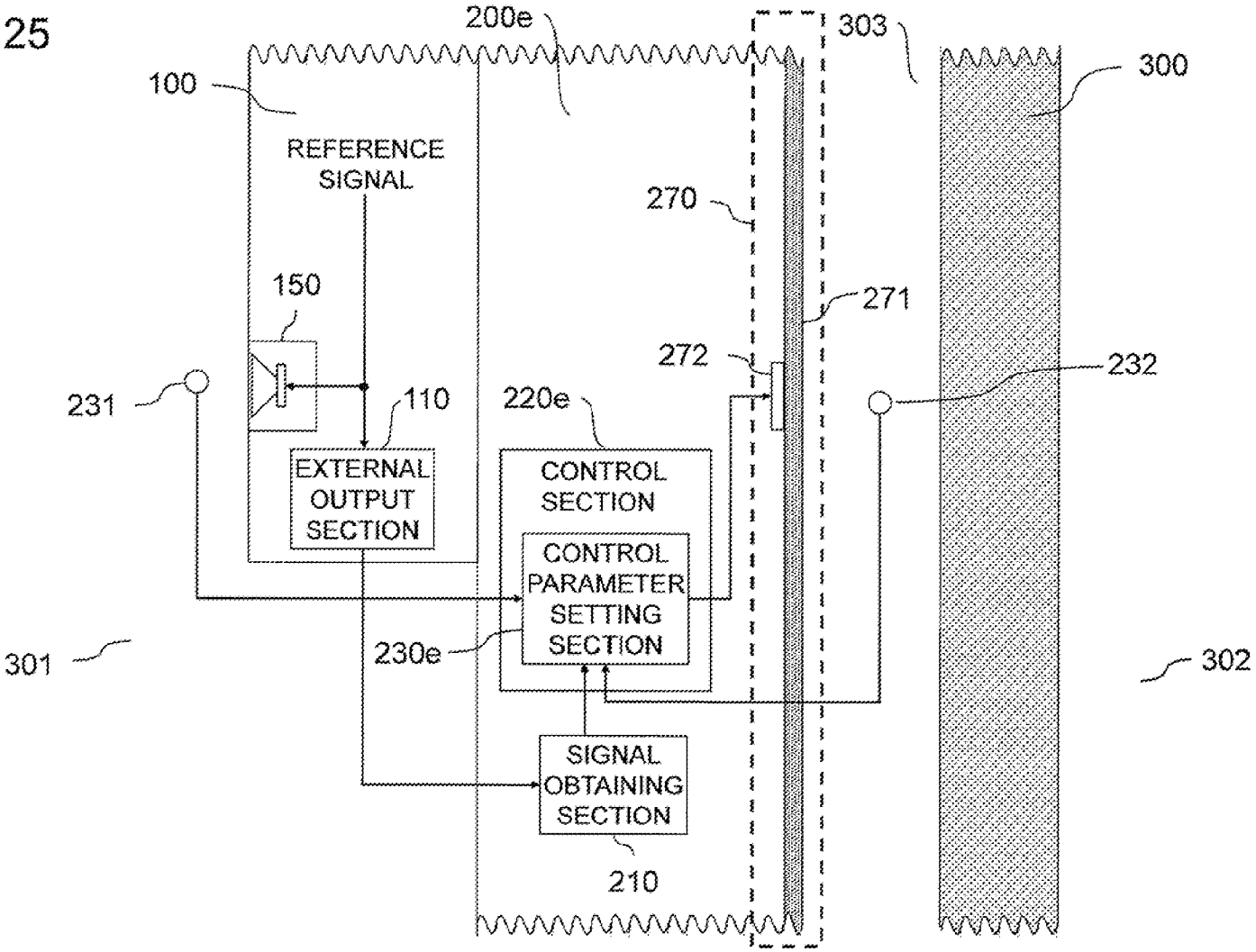
FIG. 25 illustrates an internal configuration of a television 100 and an active noise control device 200*e* according to a third embodiment of the present invention.

FIG. 25 illustrates an internal configuration of a television 100 and an active noise control device 200*e* according to the third embodiment of the present invention. The active noise control device 200*e* is the same as the active noise control device shown in FIG. 6, except that the control section 220*a* is replaced with a control section 220*e*. Thus, descriptions of the components except the control section 220*e* are omitted. The control section 220*e* includes a control parameter setting section 230*e*.

Figure 26:
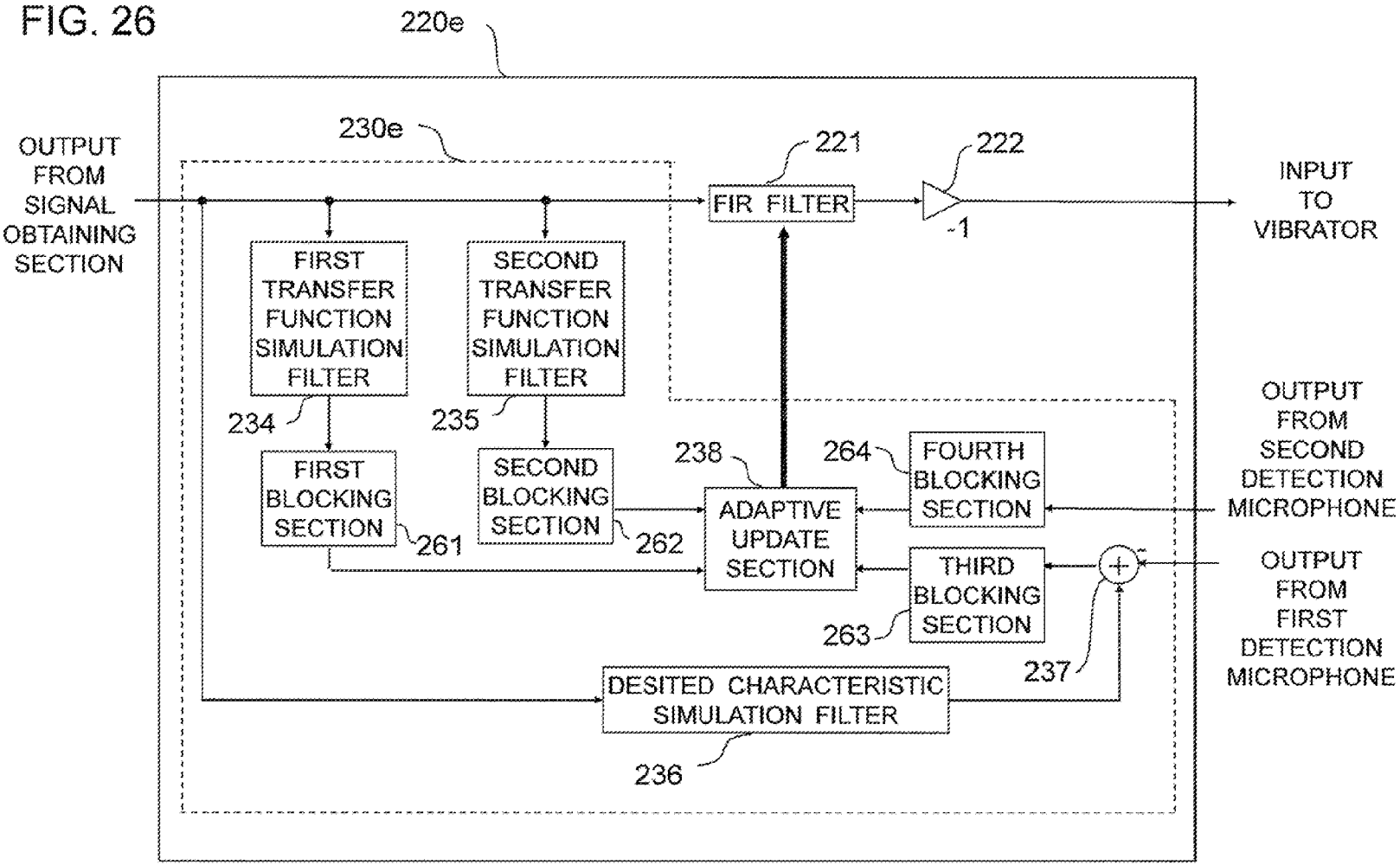
FIG. 26 illustrates an internal configuration of a control section 220*e* according to the third embodiment of the present invention.

FIG. 26 illustrates an internal configuration of the control parameter setting section 230*e*. The control parameter setting section 230*e* includes, in addition to the configuration of the control parameter setting section 230 in FIG. 7, a first blocking section 261, a second blocking section 262, a third blocking section 263, and a fourth blocking section 264. The first blocking section 261 removes a signal component of a first predetermined frequency from an output from a first transfer function simulation filter 234. The second blocking section 262 removes a signal component of a second predetermined frequency from an output from a second transfer function simulation filter 235. The third blocking section 263 removes a signal component of the first predetermined frequency from a value, which is obtained by subtracting an output from the desired characteristic simulation filter 236 from an output from the first detection microphone 231. The fourth blocking section 264 removes a signal component of the second predetermined frequency from an output from the second detection microphone 232.

With this configuration, the adaptive update section 238 does not update coefficients with respect to the components of the first predetermined frequency and the second predetermined frequency. With respect to the first predetermined frequency, even if the FIR filter 221 operates based on the filter coefficient of the FIR filter 221 that has converged, a sound radiated from the speaker 150 cannot be improved so that the sound has a desired characteristic having an increased sound pressure level of a low-frequency component in the region 301. Likewise, with respect to the second predetermined frequency, a sound radiated from the speaker 150 cannot be cancelled in the region 303.

The first and the second predetermined frequencies are set so that the frequency components thereof are not controlled by the control section 220*e* when the control adjusted by the coefficients that have converged based on [Formula 7] has a low accuracy and increases control errors.

As described above, when the sound radiated from the diaphragm 271 toward the region 301 is in opposite phase to the sound radiated from the diaphragm 271 toward the region 303 as shown in FIG. 5, [Formula 7] converges, resulting in highly accurate coefficients. In other words, when the speaker 150 and the vibrating section 270 generate sounds of the same frequency, suppose the phase difference between the phase of a detection wave of an output sound of the speaker 150 detected by the first detection microphone 231 and the phase of a detection wave of the same output sound detected by the second detection microphone 232 is denoted by $\Delta\Phi_H$, and suppose the phase difference between the phase of a detection wave of an output sound of the vibrating section 270 detected by the first detection microphone 231 and the phase of a detection wave of the same sound detected by the second detection microphone 232 is denoted by $\Delta\Phi_C$, at a frequency where the difference between $\Delta\Phi_H$ and $\Delta\Phi_C$ is close to 180 degrees, highly accurate coefficients can be obtained based on [Formula 7]. On the other hand, the higher the frequency becomes, the shorter the wavelength of sound becomes, which results in greater $\Delta\Phi_H$ and $\Delta\Phi_C$. Further, $\Delta\Phi_H$ and $\Delta\Phi_C$ change differently due to the difference between the acoustic propagation paths from the speaker 150 to each of the detection microphones 231 and 232, and the acoustic propagation paths from the active noise control device 200*e* to each of the detection microphones 231 and 232.

Figure 27:
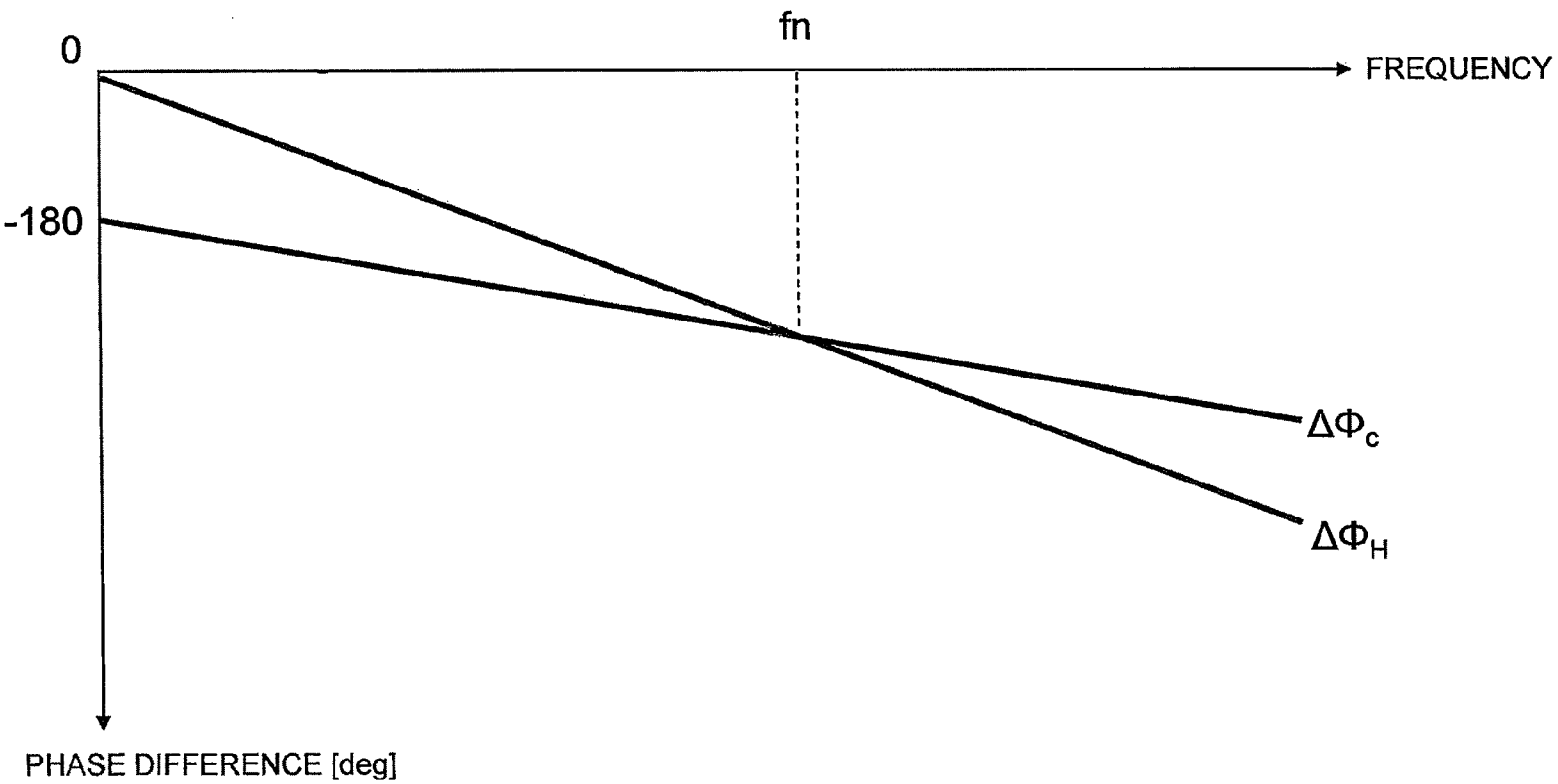
FIG. 27 illustrates the relationship between a frequency of a generated sound and a phase difference between sounds detected by each of detection microphones according to the third embodiment of the present invention.
Figure 28:
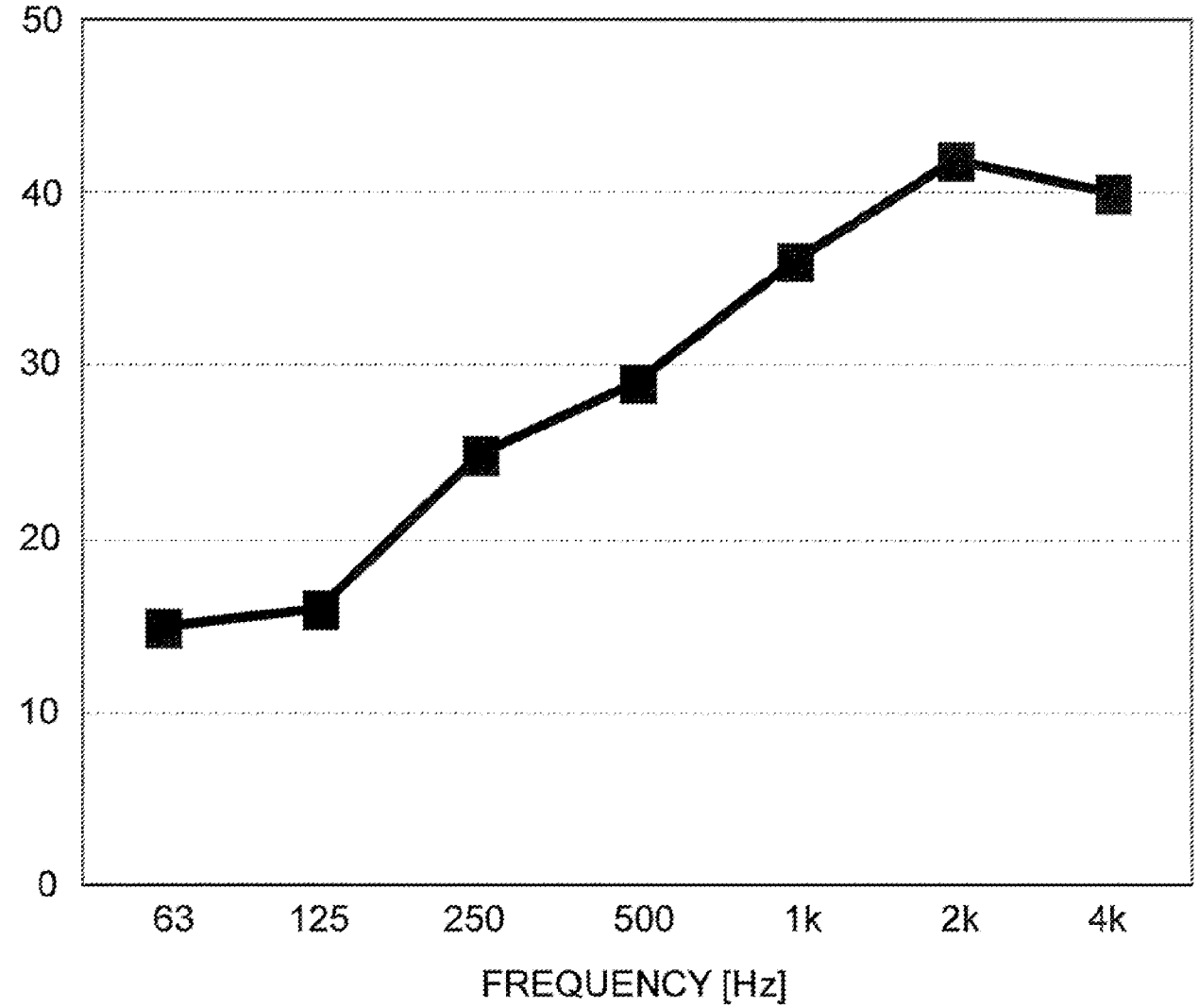
FIG. 28 illustrates an example of a sound transmission loss characteristic of an internal residential wall.
Figure 29:
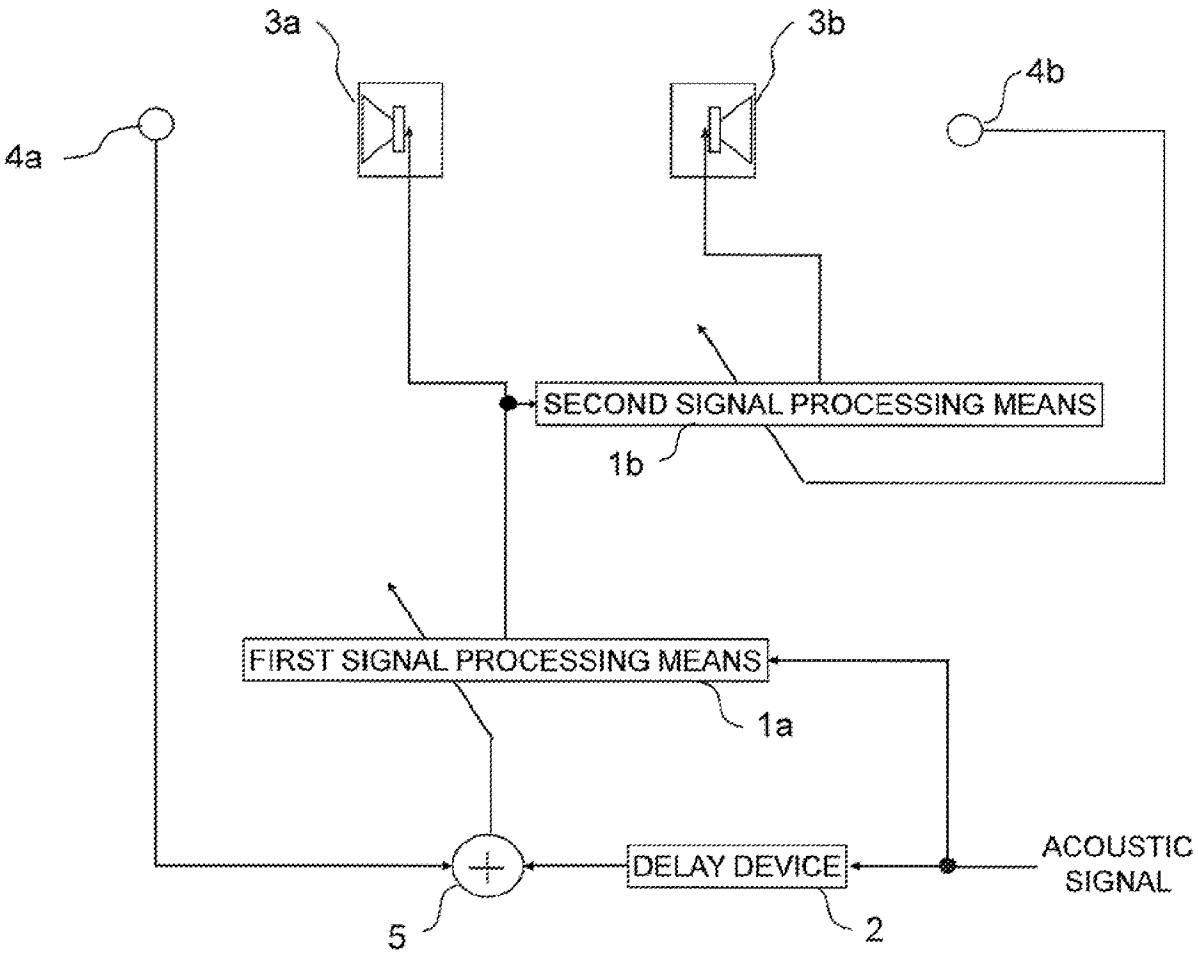
FIG. 29 PRIOR ART
FIG. 29 illustrates a configuration of an example of the prior art of the present invention.

FIG. 27 illustrates an example of the phase difference $\Delta\Phi_H$ and the phase difference $\Delta\Phi_C$ at each frequency. According to this, there is a frequency fn at which $\Delta\Phi_H$ is equal to $\Delta\Phi_C$. At the frequency fn, the phase difference between a sound radiated from the speaker 150 and a sound radiated from the active noise control device 200*e*, both sounds detected by the first detection microphone 231, is equal to the phase difference between a sound radiated from the speaker 150 and a sound radiated from the active noise control device 200*e*, both sounds detected by the second detection microphone 232. Accordingly, at the frequency fn, the active noise control device 200*e* cannot improve an acoustic output in the region 301 so that the acoustic output has a desired characteristic, and simultaneously cancel a sound in the region 303. Therefore, the active noise control device 200*e* sets processing coefficients of the FIR filter 221 so that the active noise control device 200*e* does not output a radiated sound of the frequency fn. To realize this, each of the first to fourth blocking sections 261 to 264 may have such a characteristic that blocks a signal of the frequency fn. Alternatively, such a characteristic that has only a function of cancelling the sound of the frequency fn, may be preset. In the latter case, the first blocking section 261 and the third blocking section 263 may have a characteristic so that the signal of the frequency fn is blocked, while the second blocking section 262 and the fourth blocking section 264 may have a characteristic so that a signal of every frequency passes through.

As described above, the processing coefficient of the FIR filter 221 is set so as not to radiate a sound of a frequency at which it is difficult for the active noise control device 200*e* to improve an acoustic output in the region 301 so that the acoustic output has a desired characteristic, and simultaneously cancel a sound in the region 303. Accordingly, there is no possibility that the active noise control device 200*e* produces an unusual sound due to a control error.

Also in the third embodiment of the present invention, the active noise control device may include a baffle plate and a speaker unit as shown in FIGS. 12 to 14. Alternatively, the active noise control device may include the signal detection microphone 252 as shown in FIG. 16. The active noise control device according to the third embodiment of the present invention is applicable, as shown in FIG. 17, for use in an audio system or the like.

Industrial Applicability

The active noise control device according to the present invention is capable of attenuating a predetermined sound in a first region, and providing a desired sound quality to the predetermined sound in a second region different from the first region. Accordingly, it is applicable to, other than a television or an audio system, a speaker system at a karaoke box, a conference hall, a wedding banquet hall, a school, a preparatory school, or the like.

DESCRIPTION OF THE REFERENCE CHARACTERS

| | |
|---|---|
| 100, 100b, 100c | television |
| 110, 110c | external output section |
| 120 | output characteristic setting receiving section |
| 121 | output characteristic setting transmitting section |
| 130 | output characteristic control section |
| 150 | speaker |
| 151 | speaker system |
| 200, 200a, 200b, 200c, 200d, 200e | active noise control device |
| 210, 210b, 210c | signal obtaining section |
| 220, 220a, 220b, 220c, 220d, 220e | control section |
| 220x, 220y, 220z | control section |
| 221, 243 | FIR filter |
| 222 | phase inverter |
| 230, 230e | control parameter setting section |
| 231 | first detection microphone |
| 232 | second detection microphone |
| 233, 233x, 233y, 233z | third detection microphone |
| 233a | fourth detection microphone |
| 234 | first transfer function simulation filter |
| 235 | second transfer function simulation filter |
| 236 | desired characteristic simulation filter |
| 237, 251 | subtractor |

-continued

| DESCRIPTION OF THE REFERENCE CHARACTERS | |
|---|---|
| 238, 245, 247 | adaptive update section |
| 240, 240d | processing characteristic update section |
| 241 | coefficient database |
| 242 | output characteristic setting detecting section |
| 244 | third transfer function simulation filter |
| 246 | fourth transfer function simulation filter |
| 250 | echo cancelling section |
| 252 | signal detection microphone |
| 261 | first blocking section |
| 262 | second blocking section |
| 263 | third blocking section |
| 264 | fourth blocking section |
| 270, 270x, 270y, 270z | vibrating section |
| 271, 271x, 271y, 271z | diaphragm |
| 272, 272x, 272y, 272z | vibrator |
| 275 | speaker unit |
| 280, 281 | baffle plate |
| 300 | boundary wall |
| 301 | viewing room |
| 302 | adjacent room |
| 303 | gap |
| 310 | ceiling |
| 311 | floor surface |
| 312 | side wall |

The invention claimed is:

1. An active noise control device that attenuates a first sound in a first region, the first sound being radiated from a speaker, the active noise control device comprising:

a vibrating section, spatially located at one side of the active noise control device and the speaker being spatially located at an opposite side of and facing against the active noise control device with respect to the vibrating section so that the vibrating section is spatially behind the speaker and the first region is spatially behind the vibrating section, radiating, by vibrating the vibrating section in accordance with a control signal, a second sound toward the first region, and a third sound toward a second region that is spatially in front of the speaker, the third sound in the second region being radiated in a phase that is opposite to a phase of the second sound in the first region;

a signal obtaining section, electrically coupled to the speaker, obtaining an electric signal relating to the first sound and inputted to the speaker; and a control section, coupled to the signal obtaining section and the vibrating section, adjusting, based on previously stored control parameters, an amplitude and a phase of the electric signal obtained by the signal obtaining section to produce an adjusted electric signal and outputting, to the vibrating section, the adjusted electric signal as the control signal so that the first sound in the first region is attenuated by the second sound in the first region and that a synthesized sound of the first sound and the third sound in the second region has a desired frequency characteristic.

2. The active noise control device according to claim 1 further comprising:

a vibration detecting section detecting vibration excited by a sound pressure in the first region, and outputting the detected vibration as an electric signal; and a first detection microphone detecting the synthesized sound of the first sound and the third sound in the second region, and outputting the detected synthesized sound as an electric signal, wherein the control section includes a control parameter setting section that sets the control parameters based on: the electric signal relating to the first sound; the electric signal outputted from the vibration detecting section; and the electric signal outputted from the first detection microphone.

3. The active noise control device according to claim 1, wherein the signal obtaining section further obtains a characteristic setting signal for setting an acoustic output characteristic of the speaker, and the control section includes a processing characteristic update section detecting the acoustic output characteristic from the characteristic setting signal to produce a detected acoustic output characteristic, and updating the control parameters, in accordance with the detected acoustic output characteristic.

4. The active noise control device according to claim 1 further comprising:

a second detection microphone detecting a sound in the first region and outputting the detected sound as an electric signal, wherein the control section includes a processing characteristic update section updating the control parameters so as to attenuate the sound detected by the second detection microphone.

5. The active noise control device according to claim 1 further comprising:

a vibration detecting section detecting vibration excited by a sound pressure in the first region, and outputting the detected vibration as an electric signal, wherein the control section includes a processing characteristic update section updating the control parameters so as to attenuate the vibration detected by the vibration detecting section.

6. The active noise control device according to claim 1 further comprising:

a third detection microphone detecting the synthesized sound of the first sound and the third sound in the second region, and outputting the detected synthesized sound as an electric signal, wherein the control section includes a processing characteristic update section updating the control parameters so that the synthesized sound detected by the third detection microphone has a desired frequency characteristic.

7. The active noise control device according to claim 1 further comprising a baffle section preventing the second sound in the first region from being propagated to the second region, and preventing the third sound in the second region from being propagated to the first region.

8. The active noise control device according to claim 1, wherein an enclosed space is provided between the first region and the second region, the enclosed space is formed at least by the vibrating section and a boundary wall located between the first region and the second region, and the second sound in the first region is propagated to the enclosed space from the vibrating section.

9. An acoustic system comprising:

the active noise control device of claim 1; and the speaker arranged in a first room, wherein the active noise control device is installed between a second room adjacent to the first room across a surface of a boundary wall and the speaker arranged in the first room, and wherein the acoustic system further includes an enclosed space formed at least by the surface of the boundary wall in the first room and the active noise control device.

* * * * *